US011648777B2

(12) United States Patent
Misumi et al.

(10) Patent No.: US 11,648,777 B2
(45) Date of Patent: May 16, 2023

(54) LIQUID EJECTION APPARATUS AND METHOD OF CONTROLLING LIQUID EJECTION APPARATUS

(71) Applicant: CANON KABUSHIKI KAISHA, Tokyo (JP)

(72) Inventors: Yoshinori Misumi, Tokyo (JP); Yuzuru Ishida, Kanagawa (JP); Maki Kato, Tokyo (JP); Takeru Yasuda, Kanagawa (JP); Tsubasa Funabashi, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/464,457

(22) Filed: Sep. 1, 2021

(65) Prior Publication Data

US 2022/0080730 A1 Mar. 17, 2022

(30) Foreign Application Priority Data

Sep. 15, 2020 (JP) ..... JP2020-154781

(51) Int. Cl.

| | |
|---|---|
| ***B41J 2/165*** | (2006.01) |
| ***B41J 2/18*** | (2006.01) |
| ***B41J 2/19*** | (2006.01) |
| *B41J 2/14* | (2006.01) |

(52) U.S. Cl.

CPC ..... *B41J 2/1652* (2013.01); *B41J 2/16517* (2013.01); *B41J 2/18* (2013.01); *B41J 2/19* (2013.01); *B41J 2/14072* (2013.01); *B41J 2202/07* (2013.01)

(58) Field of Classification Search

CPC ..... B41J 2/14072; B41J 2/14129; B41J 2/16517; B41J 2/18; B41J 2/19; B41J 2/1652; B41J 2202/07

See application file for complete search history.

(56) References Cited

U.S. PATENT DOCUMENTS

| | | | | |
|---|---|---|---|---|
| 8,123,330 | B2 | 2/2012 | Sakai et al. | 347/22 |
| 8,167,402 | B2 | 5/2012 | Misumi et al. | 347/35 |
| 10,994,543 | B2 * | 5/2021 | Kameshima | B41J 2/1404 |
| 11,059,301 | B2 * | 7/2021 | Nakano | B41J 2/18 |

FOREIGN PATENT DOCUMENTS

| | | |
|---|---|---|
| JP | 2008-105364 | 5/2008 |

OTHER PUBLICATIONS

U.S. Appl. No. 17/468,382, filed Sep. 7, 2021.

* cited by examiner

*Primary Examiner* — Geoffrey S Mruk
(74) *Attorney, Agent, or Firm* — Venable LLP

(57) ABSTRACT

An object is to provide a liquid ejection apparatus and a method of controlling a liquid ejection apparatus capable of preventing bubbles generated by kogation removal from interfering with the kogation removal. To this end, in a long liquid ejection head with a liquid circulated therethough, a pressure chamber is pressurized and a voltage is applied to a heat applying portion and an electrode to perform kogation removing cleaning.

12 Claims, 18 Drawing Sheets

LIQUID EJECTION APPARATUS AND METHOD OF CONTROLLING LIQUID EJECTION APPARATUS

BACKGROUND OF THE INVENTION

Field of the Invention

The present invention relates to a liquid ejection apparatus including a liquid ejection head that ejects a liquid and to a method of controlling a liquid ejection apparatus.

Description of the Related Art

In a liquid ejection head that ejects an ink by means of an action of heaters, as ink ejection is repeated, a component in the ink is heated at high temperature. This results in a phenomenon that the component turns into a substance which is difficult to dissolve or disperse, and this gets attached to the surface of an upper protection layer on each heater. This attached substance is what is called "kogation". In a case where kogation is attached to and builds up on the upper protection layer, the thermal energy applied from the heater cannot be sufficiently transferred to the ink, so that the thermal energy to be applied to the ink decreases. This may lead to a failure to achieve desired ejection. Such a deterioration in ejection performance may be a cause of image unevenness.

Japanese Patent Laid-Open No. 2008-105364 discloses that iridium or ruthenium is used as the material of an upper protection layer that chemically and physically protects electrothermal conversion elements, and a surface (heat applying portions) of the upper protection layer is dissolved into a liquid by an electrochemical reaction to remove kogation.

During the electrochemical reaction, bubbles are generated at the surface of the upper protection layer. In the case where bubbles are generated as above, the electrochemical reaction stops due to the bubbles, which makes it impossible to perform sufficient kogation removal. To address this, Japanese Patent Laid-Open No. 2008-105364 discloses a method in which, in kogation removal, a recovery process involving covering each ejection head with a cap to suck the liquid (ink) therein is performed to remove the generated bubbles by suction.

Here, with a method such as in Japanese Patent Laid-Open No. 2008-105364, there is a possibility that bubbles interfere with the kogation removal and therefore sufficient kogation removal cannot be achieved. In particular, in the case of a long line liquid ejection head, the suction recovery process is usually performed nozzle by nozzle by scanning the cap along the nozzle arrays in the liquid ejection head. Thus, in a case of performing kogation removal simultaneously on a plurality of heat applying portions, there will be nozzles with bubbles generated due to the kogation removal but not sucked. In a case where bubbles generated by kogation removal separate the liquid and the heat applying portions, it interferes with the electrochemical reaction, which may lead to a failure to achieve sufficient kogation removal.

Also, in a case of providing a capping unit that covers all nozzles in the liquid ejection head and perform suction with it, there is a problem that the size of the apparatus configuration including pipes and a suction pump increases and the cost increases.

SUMMARY OF THE INVENTION

In view of the above, the present invention provides a liquid ejection apparatus and a method of controlling a liquid ejection apparatus capable of preventing bubbles generated by kogation removal from interfering with the kogation removal.

To this end, a liquid ejection apparatus of the present invention includes: a liquid ejection head that has an electrothermal conversion element which heats a liquid, a heat applying portion to which heat of the electrothermal conversion element is applied, a pressure chamber in which a bubble is generated in the liquid by heat of the heat applying portion, an electrode provided in the pressure chamber and electrically connectable to the heat applying portion through the liquid, which contains an electrolyte, a supply valve capable of opening and closing a supply path through which to supply the liquid to the pressure chamber, and a collection valve capable of opening and closing a collection path into which to collect the liquid from the pressure chamber, and that ejects the liquid from an ejection port communicated with the pressure chamber by means of an action of the electrothermal conversion element; a voltage application unit capable of applying a voltage to the heat applying portion and the electrode; a supply pump that supplies the liquid to the pressure chamber; and a control unit that, in a cleaning process, performs control which causes the voltage application unit to apply the voltage to the heat applying portion and the electrode, opens the supply valve, closes the collection valve, and drives the supply pump.

According to the present invention, it is possible to provide a liquid ejection apparatus and a method of controlling a liquid ejection apparatus capable of preventing bubbles generated by kogation removal from interfering with the kogation removal.

Further features of the present invention will become apparent from the following description of exemplary embodiments with reference to the attached drawings.

DESCRIPTION OF THE EMBODIMENTS

An embodiment of the present invention will be described below with reference to the drawings.

Figure 1:
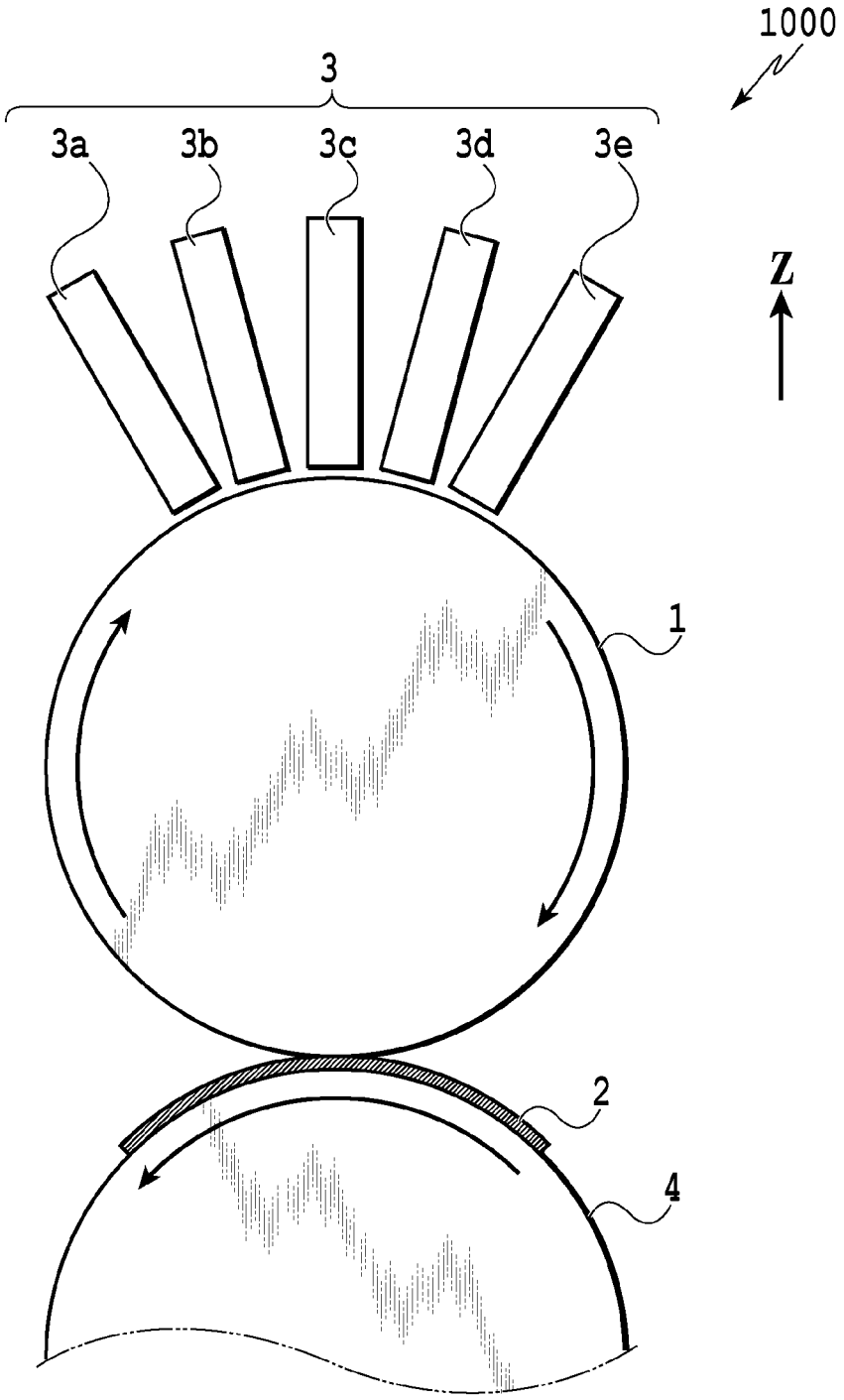
FIG. 1 is a diagram illustrating a schematic configuration of a liquid ejection apparatus.

FIG. 1 is a view illustrating a schematic configuration of a liquid ejection apparatus (hereinafter, also referred to as "printing apparatus") 1000 to which the present embodiment is applicable. The printing apparatus 1000 in the present embodiment is an apparatus that circulates each of liquids such as inks between a buffer tank 1003 (see FIG. 2) and a liquid ejection head 3 and ejects the ink in the form of ink droplets out of the circulated inks. Also, each liquid ejection head 3 is a so-called long line head having a length corresponding to the width of a print medium, and performs printing by ejecting the liquid (liquid droplets) from a plurality of ejection ports arrayed in the width direction of the print medium. Note that the present invention is also applicable to so-called serial liquid ejection apparatuses that perform printing with a scan over a print medium.

The printing apparatus 1000 includes a conveyance drum 1 that rotationally conveys a transfer body, and the line liquid ejection heads 3 disposed substantially perpendicularly to the surface of the conveyance drum 1. The liquid ejection heads 3 perform one-pass continuous printing on the transfer body attached to the surface of the conveyance drum 1 while rotationally conveying it, and, from the printed transfer body, the printed object is transferred onto a print medium 2 attached to a transfer drum 4. The print medium 2 is not limited to a cut sheet and may be a continuous roll sheet.

The printing apparatus 1000 includes five single-color liquid ejection heads (3*a*, 3*b*, 3*c*, 3*d*, and 3*e*) for five types of inks that are CMYKT (cyan, magenta, yellow, black, and transparent function inks).

Figure 2:
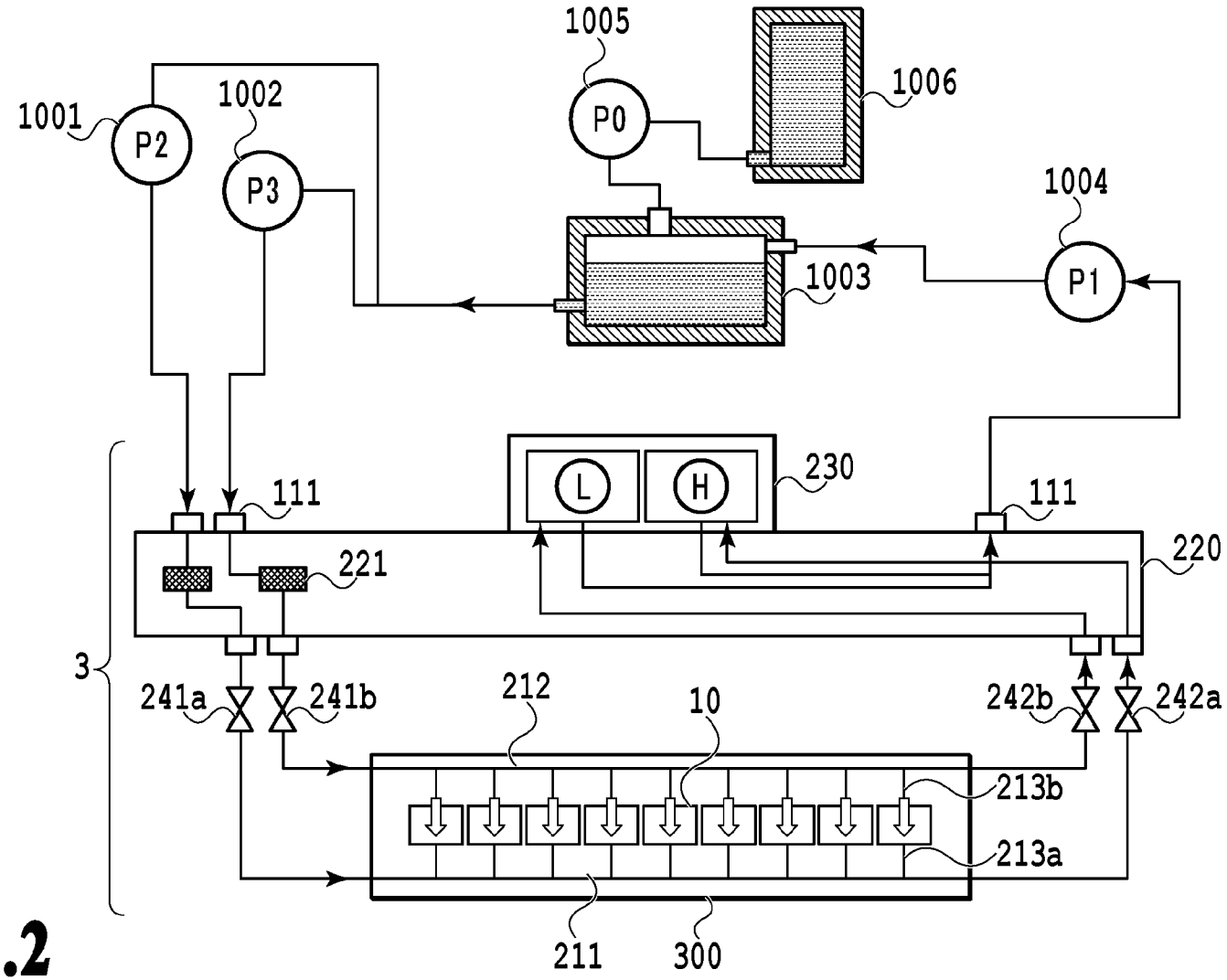
FIG. 2 is a schematic diagram illustrating a liquid circulation path in the printing apparatus.

FIG. 2 is a schematic diagram illustrating an ink circulation path in the printing apparatus 1000 in the present embodiment. Note that while FIG. 2 illustrates only the flow path for the ink of one color among the CMYKT inks for a simple explanation, the main body of the printing apparatus is actually provided with circulation paths for the five colors. The circulation path in the printing apparatus 1000 is provided with a buffer tank 1003, supply units 220, an ejection unit 300, and negative pressure control units 230, and the ink is circulated through the circulation path by driving first circulation pumps 1001 and 1002 and a second circulation pump 1004. The liquid ejection head 3 includes the ejection unit 300, the negative pressure control units 230, the supply units 220, connection parts 111, valves 241*a* and 241*b* serving as supply valves, and valves 242*a* and 242*b* serving as collection valves. The valves 241*a* and 241*b* are configured to be capable of opening and closing supply channels extending to the ejection unit 300. The valves 242*a* and 242*b* are configured to be capable of opening and closing collection channels extending from the ejection unit 300.

Also, the buffer tank 1003, serving as a sub tank, has an atmosphere communication port (not illustrated) through which the inside and outside of the tank communicate with each other, and is capable of discharging air bubbles in the ink to the outside. The buffer tank 1003 is also connected to a replenishment pump 1005. In a case where the ink is consumed at the liquid ejection head 3 as a result of ejecting the ink from the ejection ports in the liquid ejection head for printing, suction recovery, or the like, which involves ejection of the ink, the replenishment pump 1005 transfers the consumed amount of the ink from a main tank 1006 to the buffer tank 1003. The two first circulation pumps 1001 and 1002 draw the ink through one of the connection parts 111 of the liquid ejection head 3 and transfer them to the buffer tank 1003. Positive displacement pumps having an ability to transfer a fixed amount of liquid are preferably used as the first circulation pumps. While specific examples include tube pumps, gear pumps, diaphragm pumps, syringe pumps, and so on, it is also possible to employ, for example, general pumps configured to ensure a fixed flow rate with a fixed flow rate valve or a relief valve disposed at the exit of the pump.

While the liquid ejection head 3 is driven, the valves 241*a* and 241*b* and the valves 242*a* and 242*b* are open. As the first circulation pump (higher-pressure side) 1001 and the first circulation pump (lower-pressure side) 1002 are driven, fixed amounts of the ink flow through a common supply channel 211 and a common collection channel 212 and thus circulate. The flow rates of the ink are preferably set at or above such flow rates that the temperature difference among the printing element substrates 10 in the liquid ejection head 3 does not affect the print image quality. Incidentally, if the flow rates are set high, the difference in negative pressure among the printing element substrates 10 will be excessively large due to pressure drops in the channels in the ejection unit 300, which will cause density unevenness in the image. It is therefore preferred to set the flow rates with the differences in temperature and negative pressure among the printing element substrates 10 taken into account.

The negative pressure control units 230 are provided between the paths of the second circulation pump 1004 and the ejection unit 300. The negative pressure control units 230 have a function of operating so as to maintain the pressures on the downstream sides of the negative pressure control units 230 (i.e., the ejection unit 300 side) at preset constant pressures even in a case where the flow rates of the ink in the circulation system vary due to a difference in printing ratio. Any mechanisms may be used as two pressure adjustment mechanisms forming the negative pressure control units 230 as long as they are capable of controlling the pressures on the downstream sides of the negative pressure control units 230 within certain ranges of variation centered at desired preset pressures.

In one example, mechanisms similar to so-called pressure-reducing regulators can be employed. In the case of using pressure-reducing regulators, it is preferred to pressurize the upstream sides of the negative pressure control units 230 with the second circulation pump 1004 via the supply units 220, as illustrated in FIG. 2. This makes it possible to reduce the impact of the hydraulic head pressure of the buffer tank 1003 on the liquid ejection head 3 and thus enhance the degree of freedom in arrangement of the buffer tank 1003 in the printing apparatus 1000.

The second circulation pump 1004 only needs to be one that exerts a certain pump head pressure or higher within the range of ink circulation flow rates to be used during the driving of the liquid ejection head 3, and a turbo-pump, a positive displacement pump, or the like can be used. Specifically, a diaphragm pump or the like can be employed. Also, instead of the second circulation pump 1004, a hydraulic head tank can be employed which is disposed with a certain hydraulic head difference relative to the negative pressure control units 230, for example.

The negative pressure control units 230 include two pressure adjustment mechanisms whose control pressures are set to be different from each other.

The ejection unit 300 is provided with individual supply channels 213*a* and individual collection channels 213*b* communicating with the common supply channel 211, the common collection channel 212, and the printing element substrates 10. The communication of the individual channels 213 with the common supply channel 211 and the common collection channel 212 generates flows such that part of the ink flows from the common supply channel 211 to the common collection channel 212 through channels inside the printing element substrates 10 (see the arrows in FIG. 2). This is because the pressure adjustment mechanisms are connected to the common supply channel 211 and the common collection channel 212, and a differential pressure is generated between the two common channels.

Figure 3A:
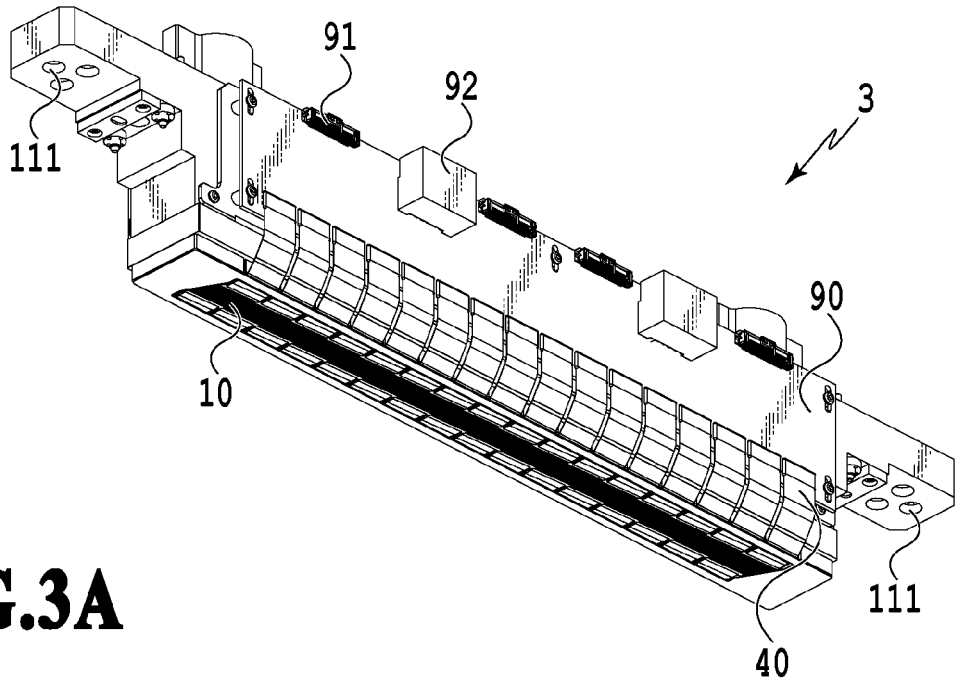
FIG. 3A is a perspective view illustrating a liquid ejection head.
Figure 3B:
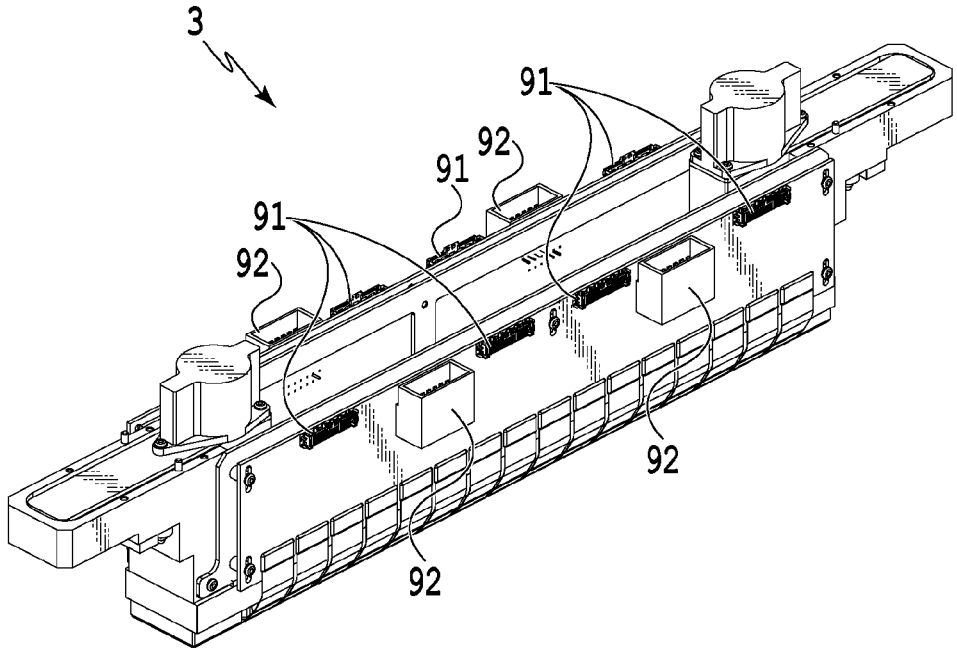
FIG. 3B is a perspective view illustrating the liquid ejection head.

FIGS. 3A and 3B are perspective views illustrating a liquid ejection head 3 in the present embodiment. The liquid ejection head 3 is a line liquid ejection head in which 16 printing element substrates 10 each capable of ejecting the ink of 1 color are arranged in a straight line (in-line arrangement). The liquid ejection heads 3 that eject the inks of the five colors are configured similarly to each other.

As illustrated in FIGS. 3A and 3B, the liquid ejection head 3 includes the printing element substrates 10, flexible wiring substrates 40, and an electric wiring substrate 90 provided with signal input terminals 91 and power supply terminals 92. The signal input terminals 91 and the power supply terminals 92 are electrically connected to a control unit in the printing apparatus 1000, and respectively supply ejection drive signals and electrical power necessary for ejection to the printing element substrates 10. The number of signal input terminals 91 and power supply terminals 92 can be made smaller than the number of printing element substrates 10 by gathering wirings in the electric circuit in the electric wiring substrate 90. This can reduce the number of electrically connected components that need to be detached in a case of mounting the liquid ejection head 3 to the printing apparatus 1000 or in a case of replacing the liquid ejection head 3.

The connection parts 111, which are provided at both end portions of the liquid ejection head 3, are connected to an ink supply system of the printing apparatus 1000. The ink is supplied from the supply system of the printing apparatus 1000 to the liquid ejection head 3 through one of the connection parts 111 and, after passing through the liquid ejection head 3, the ink is collected into the supply system of the printing apparatus 1000 through the other of the connection parts 111. Thus, the liquid ejection head 3 is configured such that the ink can be circulated through the paths in the printing apparatus 1000 and the paths in the liquid ejection head 3.

Figure 4:
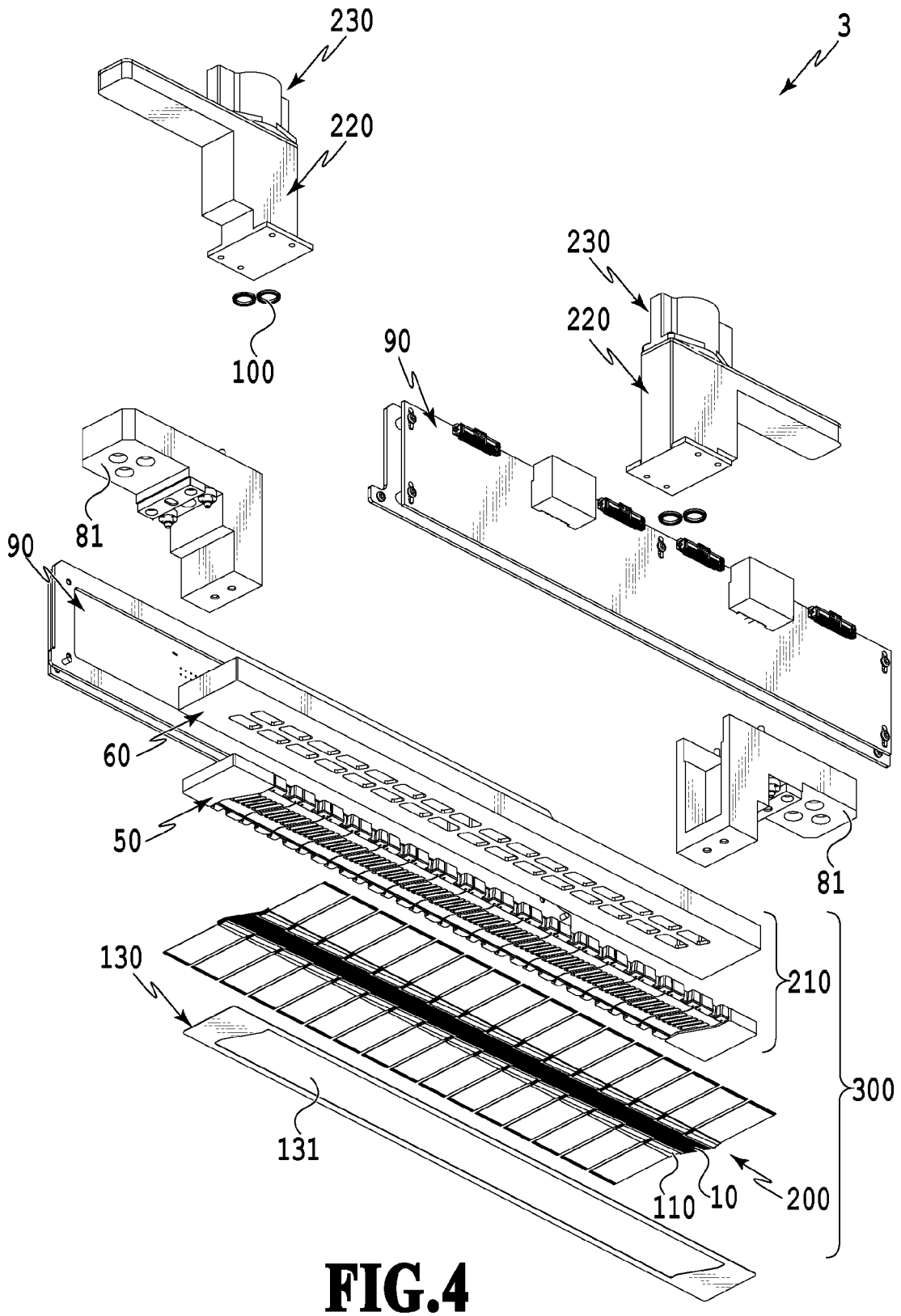
FIG. 4 is an exploded perspective view illustrating constituent components or units of the liquid ejection head.

FIG. 4 is an exploded perspective view illustrating constituent components or units of the liquid ejection head 3. The liquid ejection head 3 includes the ejection unit 300, the supply units 220, the electric wiring substrate 90, and ejection unit support parts 81.

In the liquid ejection head 3, a second channel member 60 included in the ejection unit 300 ensures the stiffness of the liquid ejection head 3. The ejection unit support parts 81 are provided at both end portions of the second channel member 60. The ejection unit 300 is mechanically coupled to a carriage of the printing apparatus 1000 via the ejection unit support parts 81, so that the liquid ejection head 3 is positioned by the carriage. The supply units 220, which include the negative pressure control units 230, and the electric wiring substrate 90 are coupled to the ejection unit support parts 81. Filters 100 are incorporated in each of the two liquid supply units 220.

The two negative pressure control units 230 are set to control the pressures in the ink paths in the liquid ejection head 3 respectively with different, higher and lower negative pressures. In a case where the negative pressure control units 230 on the higher-pressure side and the lower-pressure side are installed respectively at both end portions of the liquid ejection head 3, ink flows are generated in the common supply channel 211 (see FIG. 2) and the common collection channel 212 (see FIG. 2) extending in the longitudinal direction of the liquid ejection head 3. As a result, the ink between the common supply channel 211 and the common collection channel 212 promotes heat exchange, thereby reducing the difference between the temperatures in the two common channels. Accordingly, the plurality of printing element substrates 10 provided along the common channels are less prone to have a temperature difference among them, and thus print unevenness due to a temperature difference is less prone to occur.

The ejection unit 300 includes a plurality of ejection modules 200 and a channel member 210, and a cover member 130 is attached to the surface of the ejection unit 300 on the print medium side. Here, the cover member 130 is a frame-shaped member provided with a long opening 131, and the printing element substrates 10 and sealing members 110 included in the ejection modules 200 are exposed from the opening 131. A frame portion around the opening 131 serves as a contact surface to be in contact with a cap that covers the liquid ejection head 3 during a standby period for printing to suppress drying of the ink in ejection ports 13. Since the contact between the frame portion around the opening 131 and the cap forms a closed space within the cap, the contact surface of the frame portion around the opening 131 and the ejection port surface of the ejection unit 300 are preferably formed flat.

Next, the channel member 210 of the ejection unit 300 will be described. The channel member 210 is first channel members 50 and the second channel member 60 laminated together, and distributes the ink supplied from the supply units 220 to the ejection modules 200. The channel member 210 also functions as a channel member through which the ink to be circulated is returned from the ejection modules 200 to the supply units 220. The second channel member 60 of the channel member 210 is a channel member in which the common supply channel 211 (see FIG. 2) and the common collection channel 212 (see FIG. 2) are formed, and has a function of mainly ensuring the stiffness of the liquid ejection head 3. For this reason, the material of the second channel member 60 is preferably one having sufficient corrosion resistance against the ink and high mechanical strength. Specifically, SUS, Ti, alumina, or the like is preferred.

Figure 5A:
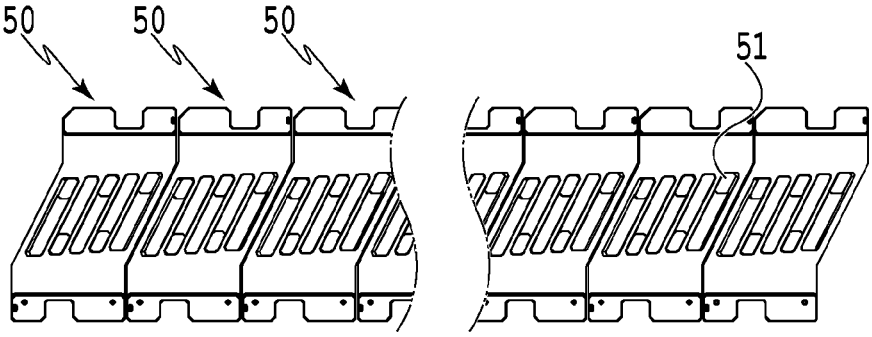
FIG. 5A is a view illustrating a channel member that distributes an ink to ejection modules.
Figure 5B:
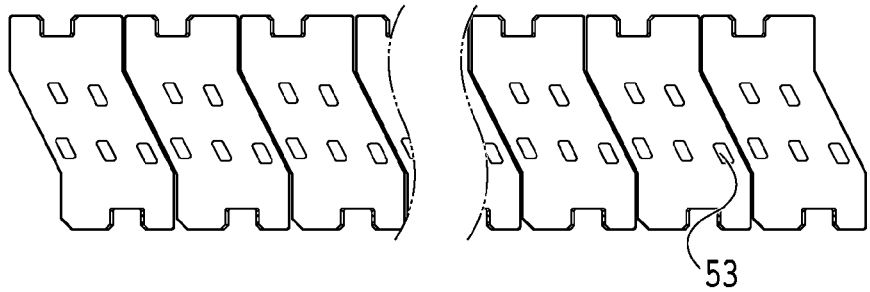
FIG. 5B is a view illustrating the channel member that distributes the ink to the ejection modules.

FIGS. 5A to 5E are views illustrating the channel members that distribute the ink supplied from the supply units 220 to the ejection modules 200. FIG. 5A is a view illustrating the surfaces of the first channel members 50 to which to mount the ejection modules 200, and FIG. 5B is a view illustrating the opposite surfaces of the first channel members 50, which are to be in contact with the second channel member 60. A first channel member 50 is provided for each ejection module 200, and the plurality of first channel members 50 are arrayed. By employing a structure divided for each individual ejection module 200 and arraying a plurality of modules as described above, it is possible to adjust to the long liquid ejection head.

Figure 5C:
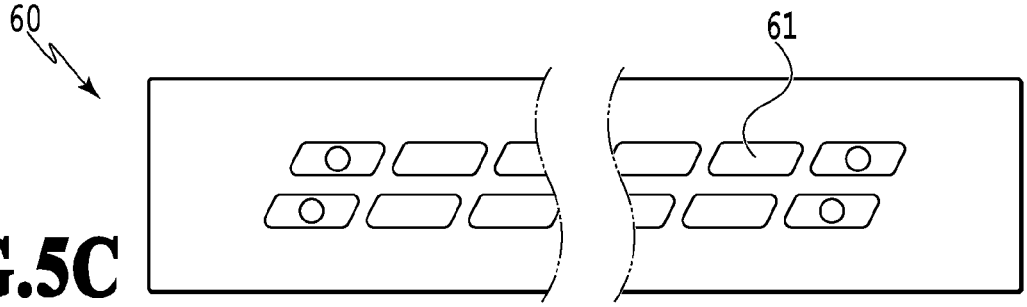
FIG. 5C is a view illustrating the channel member that distributes the ink to the ejection modules.
Figure 5D:
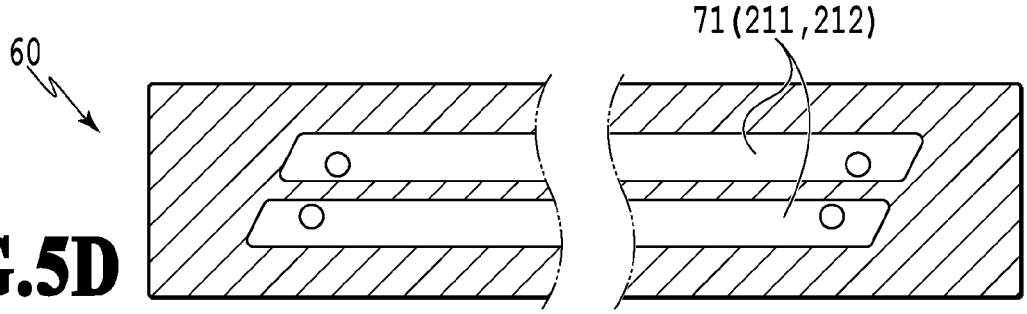
FIG. 5D is a view illustrating the channel member that distributes the ink to the ejection modules.
Figure 5E:
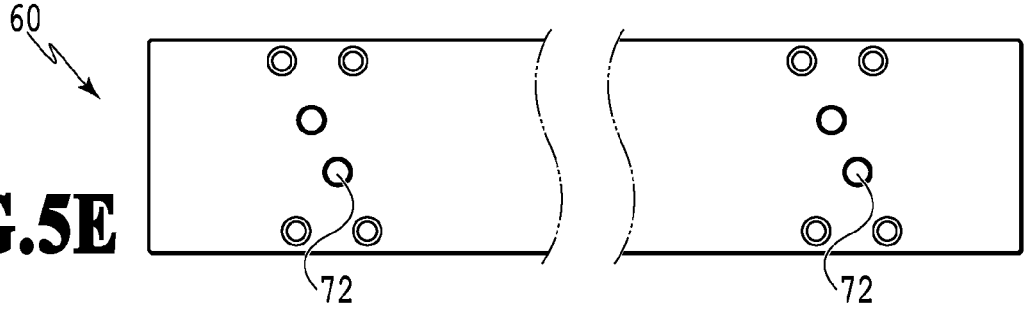
FIG. 5E is a view illustrating the channel member that distributes the ink to the ejection modules.

Communication ports 51 in the first channel members 50 fluidly communicate with the ejection modules 200 (see FIG. 4), and individual communication ports 53 in the first channel member 50 fluidly communicate with communication ports 61 in the second channel member 60. FIG. 5C is a view illustrating the surface of the second channel member 60 to be in contact with the first channel members 50. FIG. 5D is a cross-sectional view of a middle portion of the second channel member 60 in its thickness direction. FIG. 5E is a view illustrating the surface of the second channel member 60 to be in contact with the supply units 220. Of two common channel grooves 71 in the second channel member 60, one is the common supply channel 211, and the other is the common collection channel 212, through each of which the ink flows in the longitudinal direction of the liquid ejection head 3 from one end side to the other end side.

Figure 6:
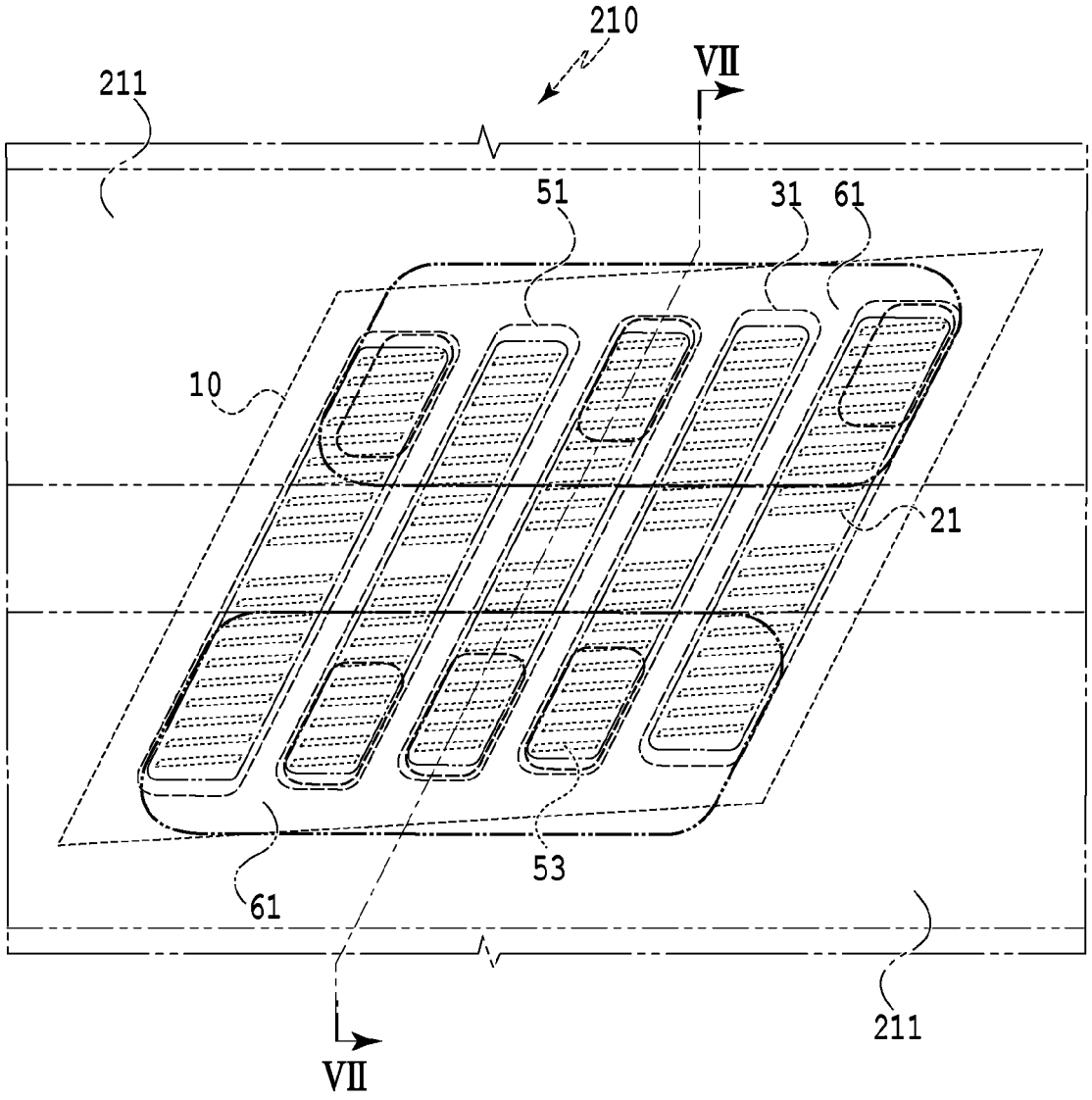
FIG. 6 is a transparent view illustrating how ink channels in a printing element substrate and the channel member are connected.

FIG. 6 is a transparent view illustrating how the ink channels in a printing element substrate 10 and the channel member 210 are connected. The paired common supply channel 211 and common collection channel 212 extending in the longitudinal direction of the liquid ejection head 3 are provided in the channel member 210. The communication ports 61 in the second channel member 60 are positioned with and connected to the individual communication ports 53 in the first channel members 50. As a result, supply paths are formed through which some communication ports 72 (see FIG. 5E) in the second channel member 60 communicate with some communication ports 51 in the first channel members 50 through the common supply channel 211. Similarly, collection paths are formed through which some communication ports 72 (see FIG. 5E) in the second channel member 60 communicate with some communication ports 51 in the first channel member 50 through the common collection channel 212.

Figure 7:
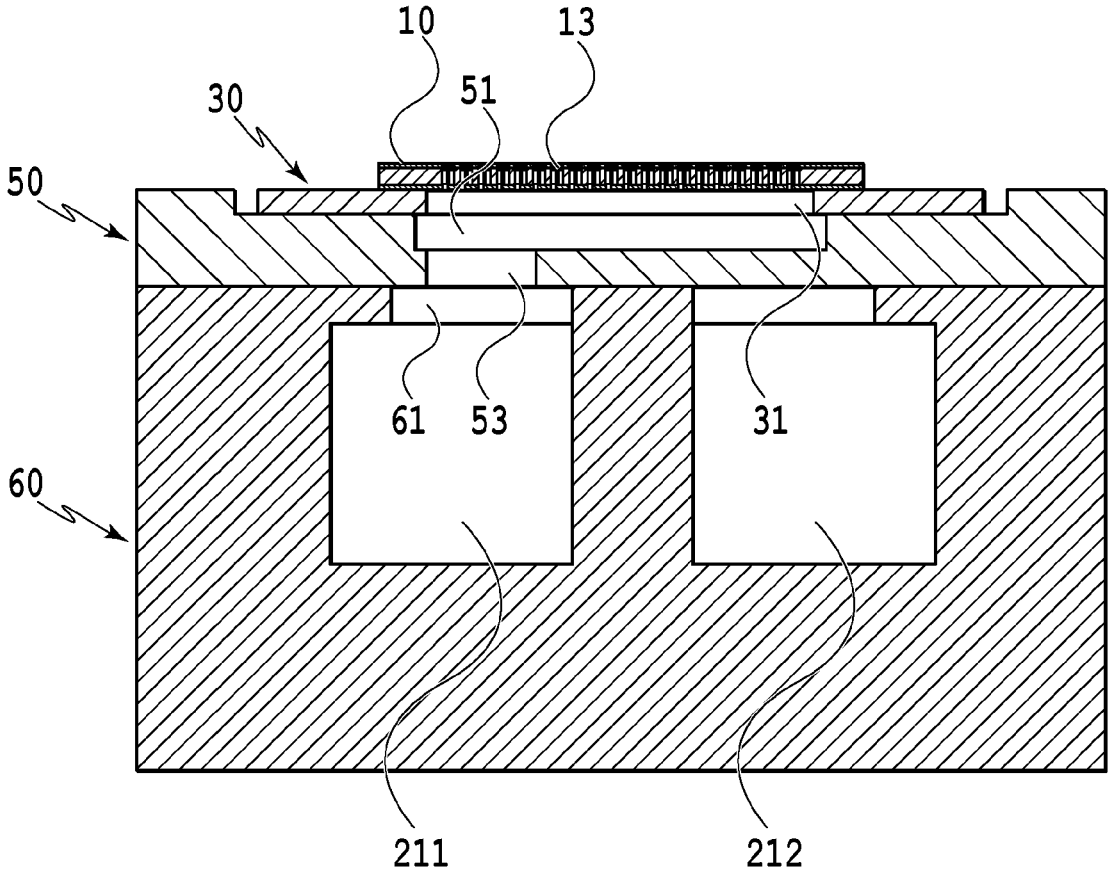
FIG. 7 is a view illustrating a cross-section along line VII-VII of FIG. 6.

FIG. 7 is a view illustrating a cross-section along line VII-VII of FIG. 6. The common supply channel 211 is connected to the ejection modules 200 through some communication ports 61, individual communication ports 53, and communication ports 51. In other words, the individual supply channels 213*a* (see FIG. 2) are formed so as to include some communication ports 61, individual communication ports 53, and communication ports 51. Although not illustrated in FIG. 7, in another cross-section, the individual collection channels 213*b* are connected to the ejection modules 200 through similar paths.

In each printing element substrate 10, channels communicating with its ejection ports 13 are formed, and these enable part or all of the ink supplied not to be ejected from the ejection ports 13 that are not involved in an ejection operation but to pass these ejection ports 13 and circulate. While an ejection operation is performed, the circulating ink is ejected from the ejection ports 13 in the form of ink droplets. Also, the common supply channel 211 and the common collection channel 212 are connected to the negative pressure control unit 230 (higher-pressure side) and the negative pressure control unit 230 (lower-pressure side), respectively, through the supply units 220. The differential pressure between the negative pressure control unit 230 (higher-pressure side) and the negative pressure control unit 230 (lower-pressure side) generates an ink flow in which the ink flows from the common supply channel 211, passes the ejection ports 13 in the printing element substrates 10, and then flows to the common collection channel 212.

Figure 8A:
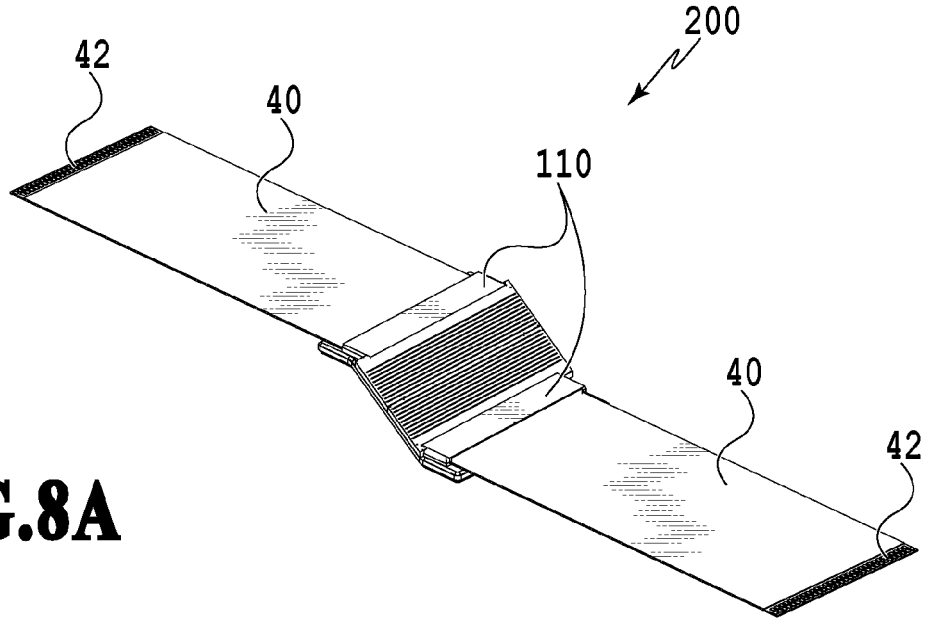
FIG. 8A is a view illustrating an ejection module.
Figure 8B:
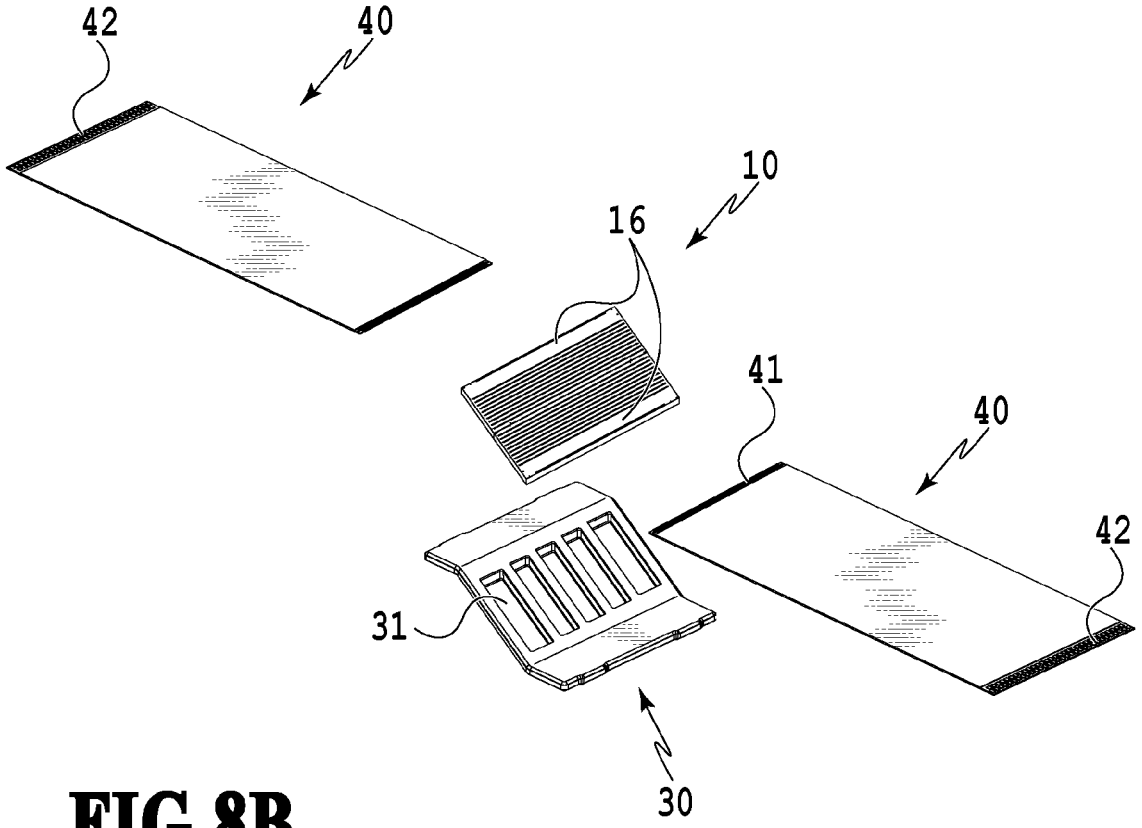
FIG. 8B is a view illustrating the ejection module.

FIGS. 8A and 8B are views illustrating an ejection module 200. FIG. 8A is a perspective view of the ejection module 200, and FIG. 8B is an exploded view thereof. The ejection module 200 includes a printing element substrate 10, a support member 30, and flexible wiring substrates 40.

An example of a method of manufacturing the ejection module 200 will be described. Firstly, the printing element substrate 10 and the flexible wiring substrates 40 are bonded onto the support member 30 provided with communication ports 31. Then, terminals 16 on the printing element substrate 10 and terminals 41 on the flexible wiring substrates 40 are electrically connected to each other by wire bonding, and thereafter the wire-bonded portions (electrically connected portions) are covered with sealing members 110 to be sealed. Terminals 42 on the flexible wiring substrates 40 opposite to the printing element substrate 10 are electrically connected to connection terminals (see FIG. 3A) on the electric wiring substrate 90. The support member 30 is a support that supports the printing element substrate 10 and also is a channel member through which to bring the printing element substrate 10 and the channel member 210 into fluid communication with each other. Thus, a support member that has high flatness and can be joined sufficiently reliably to the printing element substrate 10 is preferred. Its material is preferably alumina or a resin material, for example.

Note that a plurality of terminals 16 are disposed respectively at both edge portions of the printing element substrate 10 along the direction of a plurality of ejection port arrays (the longer edge portions of the printing element substrate 10). Moreover, for the one printing element substrate 10, there are disposed two flexible wiring substrates 40 to be electrically connected to the terminals 16. Such a configuration can shorten the maximum distance from each terminal 16 to the corresponding printing element and accordingly reduce the voltage drop and signal transfer delay occurring in a wiring portion in the printing element substrate 10.

Figure 9A:
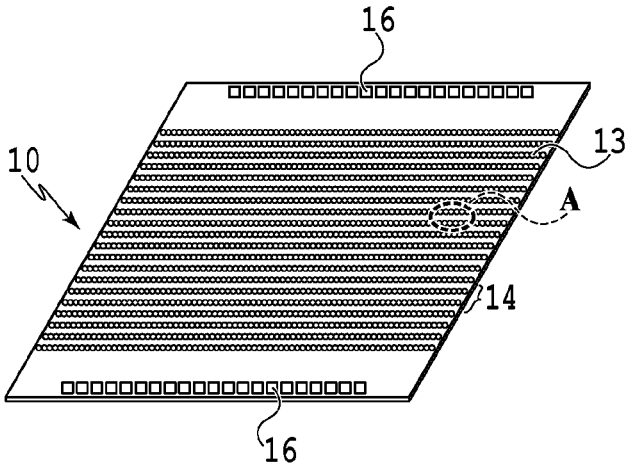
FIG. 9A is a view illustrating a printing element substrate.
Figure 9B:
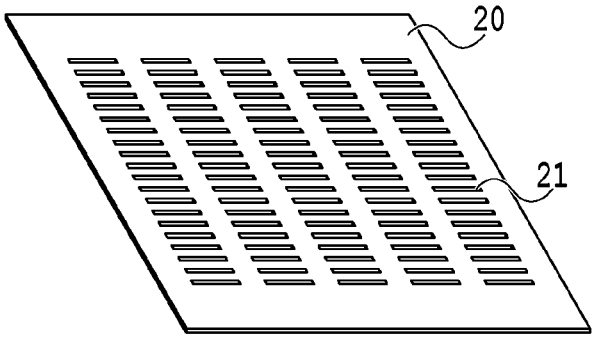
FIG. 9B is a view illustrating the printing element substrate.
Figure 9C:
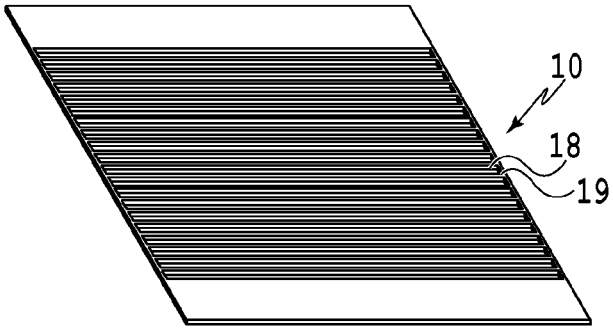
FIG. 9C is a view illustrating the printing element substrate.
Figure 9D:
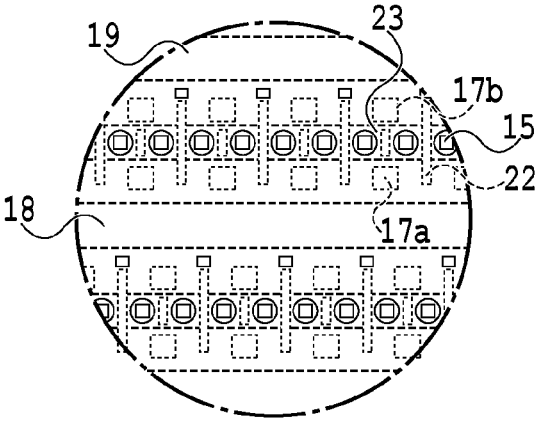
FIG. 9D is a view illustrating the printing element substrate.
Figure 10:
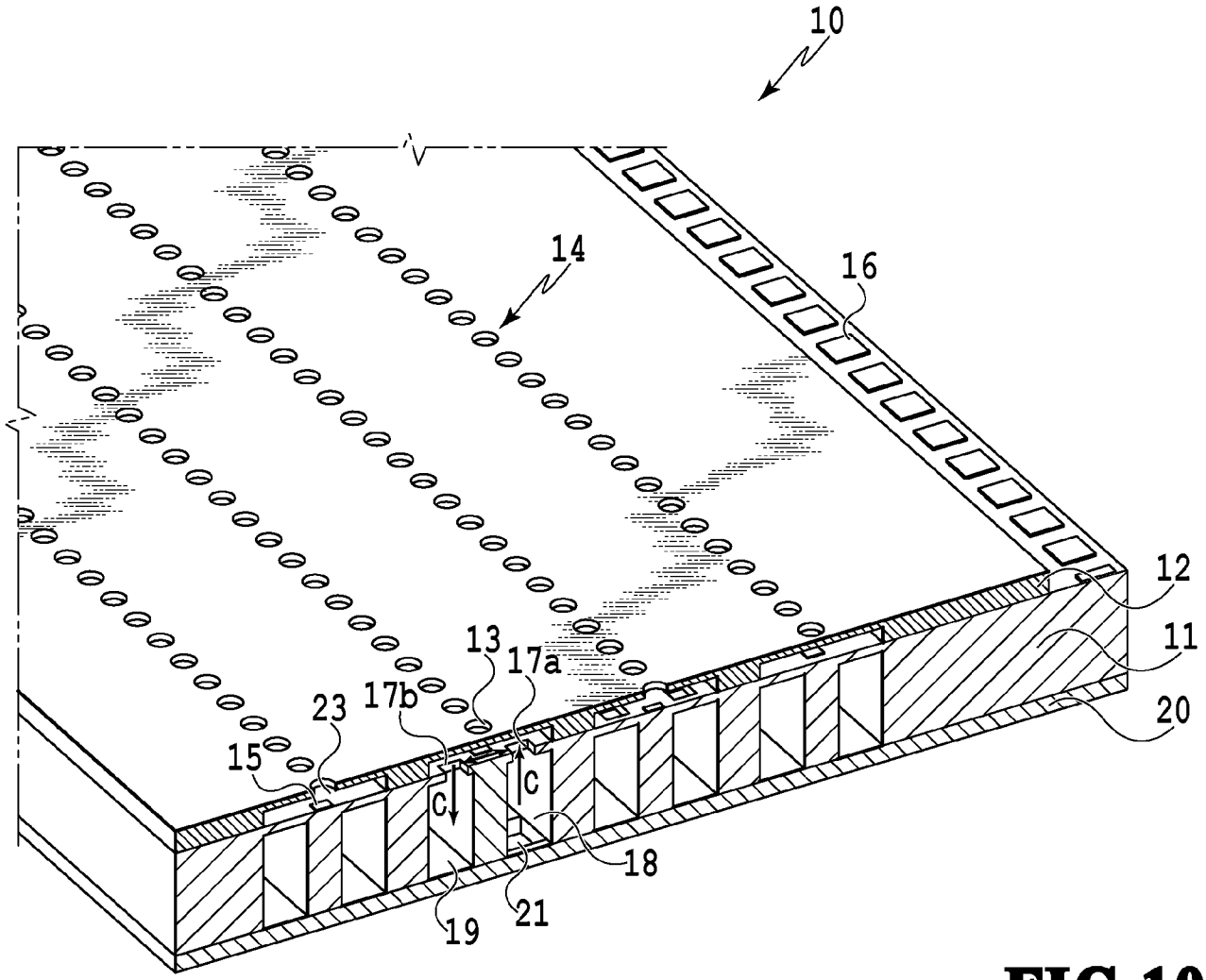
FIG. 10 is a perspective view illustrating a cross-section of the printing element substrate.

FIGS. 9A to 9D are views illustrating a printing element substrate 10. FIG. 9A is a schematic view illustrating the surface of the printing element substrate 10 where its ejection ports 13 are disposed, and FIG. 9B is a schematic view illustrating the back surface in FIG. 9A. FIG. 9C is a schematic view illustrating the back surface of the printing element substrate 10 in a state where a lid member 20 provided on the back surface of the printing element substrate 10 in FIG. 9B is removed. FIG. 9D is an enlarged view of a portion A in FIG. 9A. FIG. 10 is a perspective view illustrating a cross-section of the printing element substrate 10.

The printing element substrate 10 includes a base plate 11 formed by laminating a plurality of layers on a silicon base, an ejection port forming member 12 made of a photosensitive resin, and the lid member 20 joined to the back surface of the base plate 11. A plurality of ejection port arrays 14 are formed in the ejection port forming member 12 of the printing element substrate 10. Note that the direction of extension of the ejection port arrays 14 each being a plurality of arrayed ejection ports 13 will be hereinafter referred to as "ejection port array direction". Printing elements 15 are formed in the base plate 11 while grooves extending in the ejection port array direction and forming the supply paths 18 and the collection paths 19 are formed on the back side. The printing elements 15 are elements that generate energy to be utilized for liquid ejection.

As illustrated in FIGS. 9C and 10, the printing element substrate 10 is provided with the supply paths 18 and the collection paths 19 extending in the ejection port array direction, and along each ejection port array 14 there is a supply path 18 provided on one side thereof and a collection path 19 provided on the other side thereof. Also, the supply paths 18 and the collection paths 19 are provided alternately in a direction crossing the ejection port array direction. Moreover, as illustrated in FIG. 9D, along the ejection port array direction, a plurality of supply ports 17*a* connected to the supply paths 18 are arrayed to form supply port arrays, and a plurality of collection ports 17*b* form collection port arrays such that the liquid flows out into the collection paths 19.

The lid member 20 of a sheet shape is laminated on the surface of the base plate 11 opposite the surface where the ejection port forming member 12 is provided. The lid member 20 is provided with a plurality of openings 21 communicating with the supply paths 18 and the collection paths 19. Each opening 21 in the lid member 20 communicates with a communication port 51 (see FIG. 7) in a first channel member 50 through a communication port 31 (see FIG. 8B) in the support member 30. The lid member 20 functions as a lid that forms part of the walls of the supply paths 18 and the collection paths 19 formed in the base plate 11 of the printing element substrate 10.

The lid member 20 is preferably a member having sufficient corrosion resistance against the link. Moreover, the opening shapes and positions of the openings 21 are required to be highly accurate. It is therefore preferred to use a photosensitive resin material or a silicon plate as the material of the lid member 20 and to provide the openings 21 by a photolithography process. As described above, the lid member converts the pitch between the channels by means of the openings 21 and, considering the pressure drop, is desirably thin and desirably formed of a film-shaped member.

As illustrated in FIG. 10, at each of positions corresponding to the ejection ports 13, a printing element 15 is disposed which is a heat generating resistive element that generates a bubble in the ink by means of thermal energy. Pressure chambers 23 each including a printing element 15 therein are defined by partitions 22 (see FIG. 9D). The printing elements 15 are electrically connected to the terminals 16 (see FIG. 9A) by electric wirings provided in the printing element substrate 10. Each printing element 15 generates heat based on a pulse signal inputted from a control circuit in the printing apparatus 1000 via the electric wiring substrate 90 (see FIG. 4) and the corresponding flexible wiring substrate 40 (see FIG. 8A) to thereby boil the ink. The force of a bubble generated by the boiling of the ink ejects an ink droplet from the ejection port 13. Note that, as will be described later, the printing elements 15 are covered with the plurality of layers provided in the base plate 11, but the printing elements 15 in FIGS. 9D and 10 are schematically illustrated in the surface of the base plate 11.

The ink flow inside the printing element substrate 10 will be described. The supply paths 18 and the collection paths 19 formed by the base plate 11 and the lid member 20 are connected respectively to the common supply channel 211 and the common collection channel 212 in the channel member 210, and a differential pressure is present between the ink flowing through the supply paths 18 and the ink flowing through the collection paths 19. During ink ejection from a plurality of ejection port 13 in the liquid ejection head 3, at each ejection port not performing an ejection operation, this differential pressure causes the ink to flow from the supply path 18 to the collection path 19 through the supply port 17*a*, the pressure chamber 23, and then the collection port 17*b* (arrows C in FIG. 10).

With this ink flow, the ink present in each ejection port 13 and pressure chamber 23 not involved in printing and thickened due to evaporation through the ejection port 13, as well as bubbles, foreign matter, and the like, can be collected into the collection path 19. The ink flow also makes it possible to suppress thickening of the ink in the ejection port 13 and the pressure chamber 23. The ink collected in the collection path 19 passes through the corresponding openings 21 in the lid member 20 and the corresponding communication ports 31 (see FIG. 7) in the support member 30, and is collected through the corresponding communication ports 51, the individual collection channel 213*b*, and the common collection channel 212 in the channel member 210 in this order to thereby circulate through the circulation path in the printing apparatus 1000.

Note that, as illustrated in FIG. 2, the ink having flowed in from one end of the common supply channel 211 in the ejection unit 300 is not entirely supplied to the pressure chambers 23 through the individual supply channels 213*a*. Specifically, there is a portion of the ink that does not flow into the individual supply channels 213*a* but flow into one of the supply units 220 from the other end of the common supply channel 211. By including these paths that allow the ink to flow without passing through the printing element substrates 10, it is possible to suppress backflow of the circulating ink flow even in the case of including printing element substrates 10 with narrow channels in which the flow resistance is large as in the present embodiment. Since the thickening of the ink in the pressure chambers 23 and in the vicinity of the ejection ports 13 can be suppressed as above, it is possible to suppress the occurrence of misdirected ejection and ejection failure in the liquid ejection heads 3.

Figure 11A:
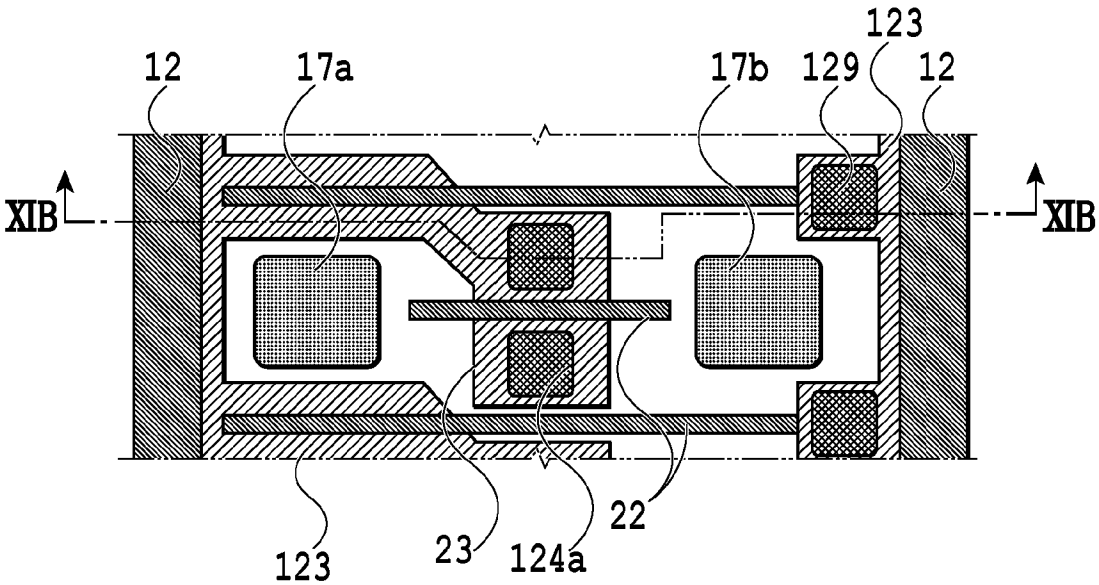
FIG. 11A is a cross-sectional view illustrating part of a printing element substrate.
Figure 11B:
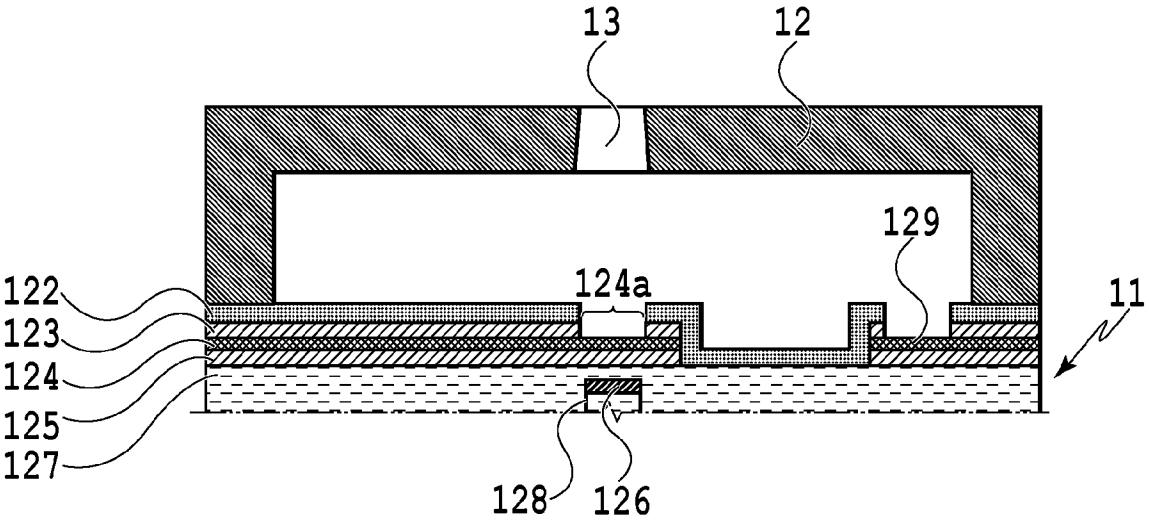
FIG. 11B is a cross-sectional view illustrating part of the printing element substrate.

FIGS. 11A and 11B are cross-sectional views illustrating part of a printing element substrate 10. FIG. 11A is a diagram of the surface of the printing element substrate 10 provided with heat applying portions 124*a*, illustrating a region around some heat applying portions 124*a* in a schematic enlarged view. FIG. 11B is a schematic cross-sectional view along line XIB-XIB of FIG. 11A. Incidentally, a second adhesion layer 122 illustrated in FIG. 11B is omitted in FIG. 11A. Note that, in order to generate a bubble in the ink, each heat applying portion 124*a* contacts the ink and applies heat to the ink.

The base plate 11 included in the printing element substrate 10 is formed by laminating a plurality of layers. In the present embodiment, a heat accumulation layer formed of a thermally oxidized film, a SiO film, a SiN film, or the like is disposed on a silicon base. Also, heat generating resistive elements 126 serving as the printing elements 15 are disposed on the heat accumulation layer. Electrode wiring layers made of a metallic material such as Al, Al—Si, or Al—Cu and serving as wirings are connected to the heat generating resistive elements 126 via plugs 128 made of tungsten or the like. The plugs 128 are disposed so as to be paired with the respective heat generating resistive elements 126, and a portion of each heat generating resistive element 126 where a current flows through the plug 128 functions as a heat generating portion for ink ejection. On the heat generating resistive elements 126, an insulating protection layer 127 is disposed so as to cover the heat generating resistive elements 126. The insulating protection layer 127 is formed of, for example, a SiO film, a SiN film, or the like.

A first protection layer 125 and a second protection layer 124 are disposed on the insulating protection layer 127. These protection layers serve to protect the surfaces of the heat generating resistive elements 126 from chemical and physical impacts resulting from the heat generation of the heat generating resistive elements 126. For example, the first protection layer 125 is made of tantalum (Ta), and the second protection layer 124 is made of iridium (Ir). Also, the protection layers made of these materials have electrical conductivity.

Moreover, a first adhesion layer 123 and the second adhesion layer 122 are disposed on the second protection layer 124. The first adhesion layer 123 serves to improve adhesion between the second protection layer 124 and another layer. The first adhesion layer 123 is made of, for example, tantalum (Ta). The second adhesion layer 122 serves to protect other layers from the ink and to improve adhesion to the ejection port forming member 12. The second adhesion layer 122 is made of, for example, SiC or SiCN.

The ejection port forming member 12, in which the ejection ports 13 are formed, is joined to the surface of the base plate 11 on the second adhesion layer 122 side, and forms channels including the pressure chambers 23 by being joined to the base plate 11. The ejection port forming member 12 has the partitions 22 each provided between adjacent heat applying portions 124*a*, and the pressure chambers 23 are defined by these partitions 22.

In ejection of the ink, on each of the heat applying portions 124*a* of the second protection layer 124, which cover the heat generating resistive elements 126 and contact the ink, the temperature of the ink rises instantaneously, so that a bubble is generated in the ink and the bubble then disappears, thereby causing cavitation. For this reason, the second protection layer 124 including the heat applying portions 124*a* is made of iridium (Ir), which has high corrosion resistance and also high cavitation resistance. The second protection layer 124 is desirably made of a material containing iridium (Ir), ruthenium (Ru), or platinum (Pt).

In the present embodiment, the base plate 11 is provided with electrodes 129 in the same layer as the second protection layer 124 as counterparts of the heat applying portions 124*a*. Also, the electrodes 129 as counterparts of the heat applying portions 124*a* are connected to a voltage application unit capable of applying voltage. The ink contains an electrolyte, and the heat applying portions 124*a* and the electrodes 129 as their counterparts are configured to be connectable to each other through the ink. As a voltage is applied to the heat applying portions 124*a* and the electrodes 129, an electrochemical reaction occurs through the ink, which dissolves a voltage-applied dissolvable layer on the one of the heat applying portions 124*a* and the electrodes 129 that electrochemically serves as an anode. That is, as the voltage is applied such that the heat applying portion 124*a* is the anode side, the voltage-applied dissolvable layer on the heat applying portion 124*a* is dissolved by an electrochemical reaction. This enables removable of kogation attached to the surface.

The electrodes 129 are disposed downstream of the heat applying portions 124*a* in the direction of flow of the ink from the supply ports 17*a* toward the collection ports 17*b*. Further, in a case where the supply ports 17*a* are disposed on one side of an array of a plurality of heat applying portions 124*a* and the collection ports 17*b* are disposed on the other side thereof, as illustrated in FIG. 9D, the electrodes 129 are disposed on the collection ports 17*b* side of the array of heat applying portions 124*a*. Incidentally, to reduce the load of the manufacturing process, the electrode layer forming the electrodes 129 is preferably made of the same material as the second protection layer 124 (iridium) as well. Also, since iridium does not form an oxidized film, using it as the material of the second protection layer 124 including the heat applying portions 124*a* can suppress blocking of the dissolution into the ink by an oxidized film.

With no ink being present between the heat applying portions 124*a* and the electrodes 129, the heat applying portions 124*a* and the electrodes 129 are not electrically connected to each other. However, with an ink containing an electrolyte being filled between the heat applying portions 124*a* and the electrodes 129, currents flow between the heat applying portions 124*a* and the electrodes 129 through the ink, so that an electrochemical reaction occurs at the interfaces between the heat applying portions 124*a* and electrodes 129 and the ink. By the electrochemical reaction, the surfaces of the heat applying portions 124*a* are dissolved into the ink. Accordingly, kogation attached to the surfaces of the heat applying portions 124*a* can be removed. The anode electrode side undergoes dissolution of its metal. Hence, in the case of removing kogation on the heat applying portions 124*a* (hereinafter referred to as kogation removing cleaning), a voltage is applied to the heat applying portions 124*a* and the electrodes 129 such that the heat applying portions 124*a* are the anode side and the electrodes 129 are the cathode side.

Figure 12A:
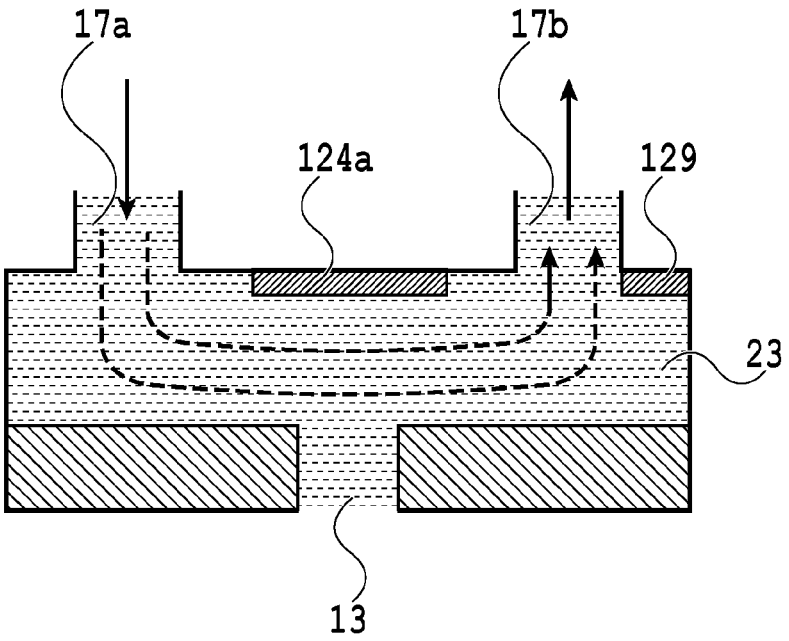
FIG. 12A is a cross-sectional view illustrating a pressure chamber.
Figure 12B:
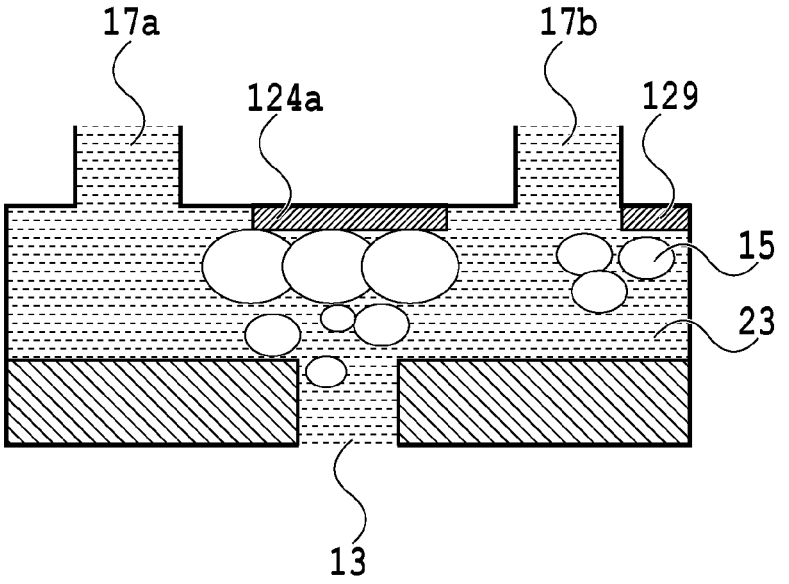
FIG. 12B is a cross-sectional view illustrating the pressure chamber.

FIGS. 12A and 12B are cross-sectional views illustrating a pressure chamber 23. FIG. 12A illustrates the pressure chamber 23 in an ink circulation period, i.e., an ejection period. FIG. 12B illustrates the pressure chamber 23 during an electrochemical reaction. In the pressure chamber 23 in the ink circulation period, the ink flows into the pressure chamber 23 from the supply port 17*a* and is discharged from the collection port 17*b*. In the electrochemical reaction in kogation removing cleaning, an anode reaction (oxidation reaction) occurs on the heat applying portion 124*a*, and a cathode reaction (reduction reaction) occurs on the electrode 129. As a result, bubbles are generated from the heat applying portion 124*a* and the electrode 129 as illustrated in FIG. 12B.

In the printing apparatus 1000 in the present embodiment, in kogation removing cleaning, the kogation on the heat applying portions 124*a* is removed and, at the same time, the inks are caused to flow with the pressure in the pressure chambers 23 raised. In this way, the bubbles generated are efficiently discharged out of the ejection ports 13 along with the inks.

Figure 13A:
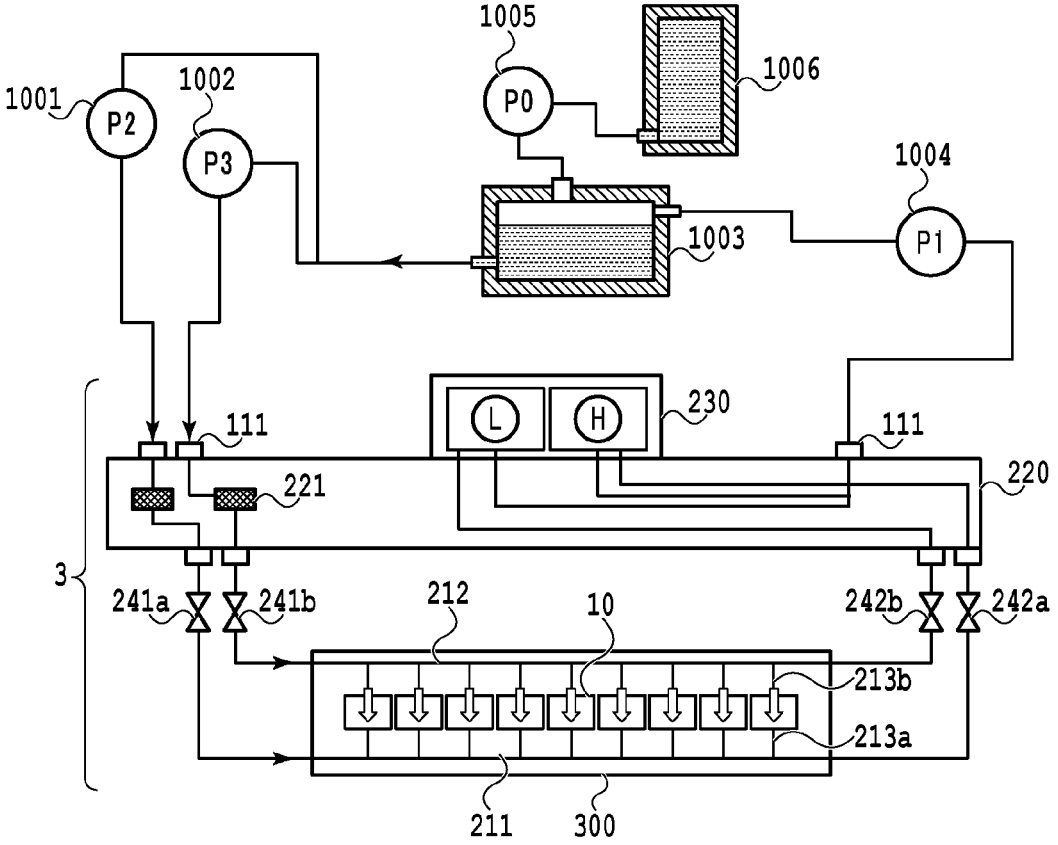
FIG. 13A is a diagram illustrating a circulation path for kogation removal.
Figure 13B:
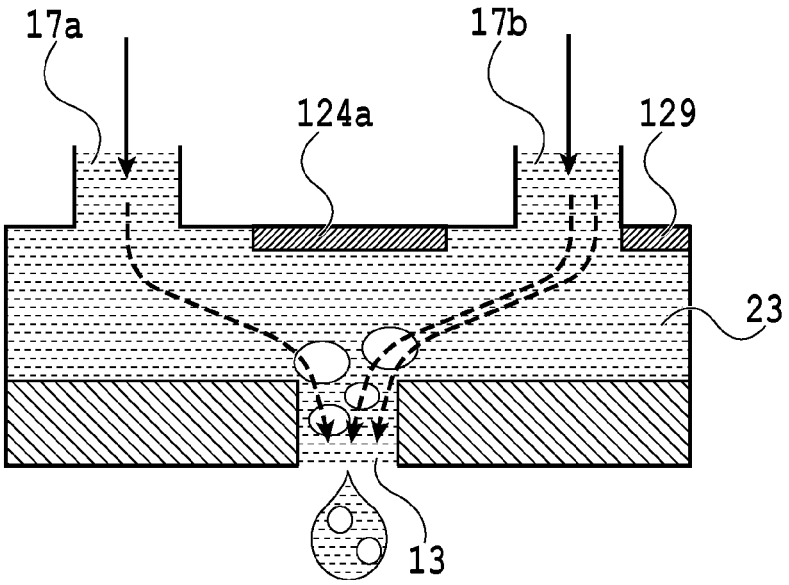
FIG. 13B is a view illustrating an ink flow in a pressure chamber in the kogation removal.

FIGS. 13A and 13B are a diagram and a view respectively illustrating a circulation path for kogation removing cleaning among the circulation paths employed by the printing apparatus 1000 in the present embodiment, and an ink flow in a pressure chamber 23 in the kogation removing cleaning. In the circulation path in FIG. 13A, the valves 242*a*, 242*b*, 241*a*, and 241*b* provided to the channels connected to the common supply channel 211 and the common collection channel 212 are such that the valves 242*a* and 242*b* are closed, and the valves 241*a* and 241*b* are open. In this state, the ink is supplied from liquid feed pumps P2 and P3, which serve as supply pumps, to the head side. As a result, unlike the liquid flows generated during an ejection operation, during which the liquid flows in from the supply ports and flows out from the collection ports, the liquid flows in from both the supply ports and the collection ports. Further, the flow rate of the liquid to be fed from the liquid feed pump P3 per unit time is set larger than the flow rate of the liquid to be fed from the liquid feed pump P2 per unit time, so that the amount of inflow from the supply ports 17*a* per unit time is larger than the amount of inflow from the collection ports 17*b* per unit time.

FIG. 13B illustrates the ink flow in a pressure chamber 23 in the circulation path of FIG. 13A. The ink flows in from the supply port 17*a* and the collection port 17*b*, so that the inside of the pressure chamber 23 becomes pressurized. As a result, bubbles are discharged from the ejection port 13 with the ink flow. Inside the pressure chamber 23, bubbles are generated at the heat applying portion 124*a* and the electrode 129, as illustrated in FIG. 12B. Thus, the amount of inflow per unit time from the collection port 17*b*, which is closer to the electrode 129, is made larger. In this way, the bubbles generated at the heat applying portion 124*a* and the electrode 129 can be efficiently discharged from the ejection port 13.

Figure 14A:
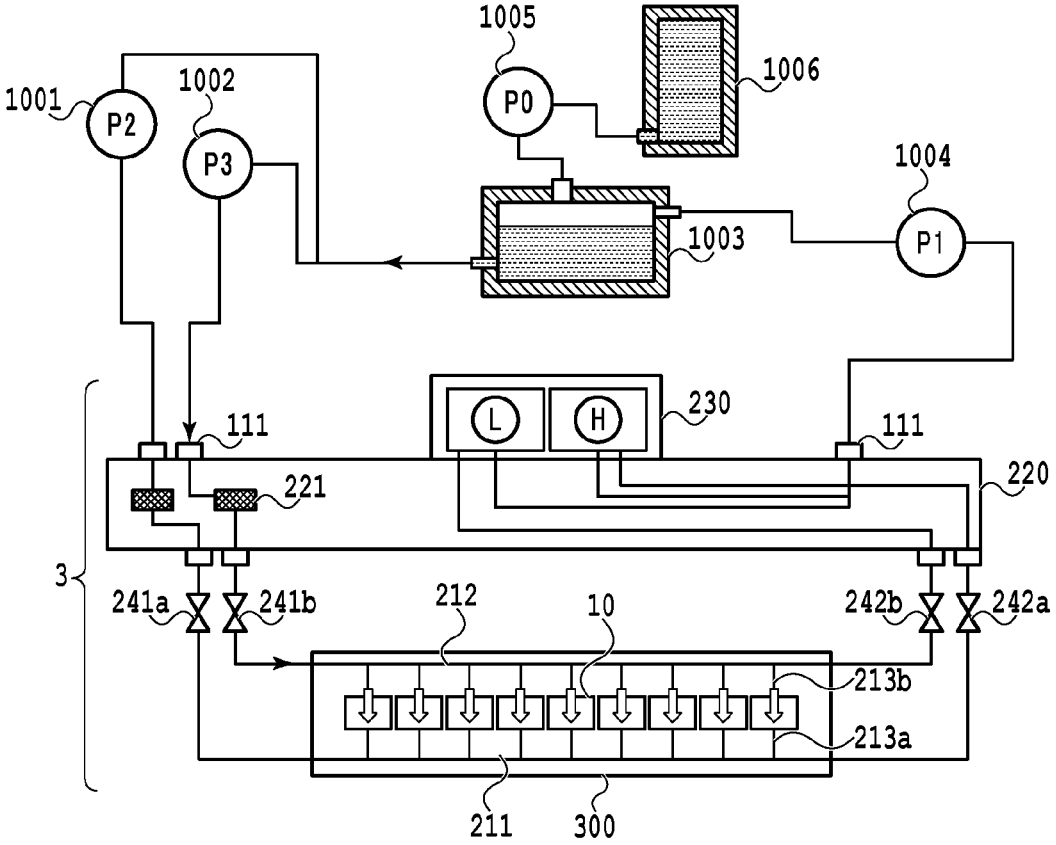
FIG. 14A is a diagram illustrating another circulation path for kogation removal.
Figure 14B:
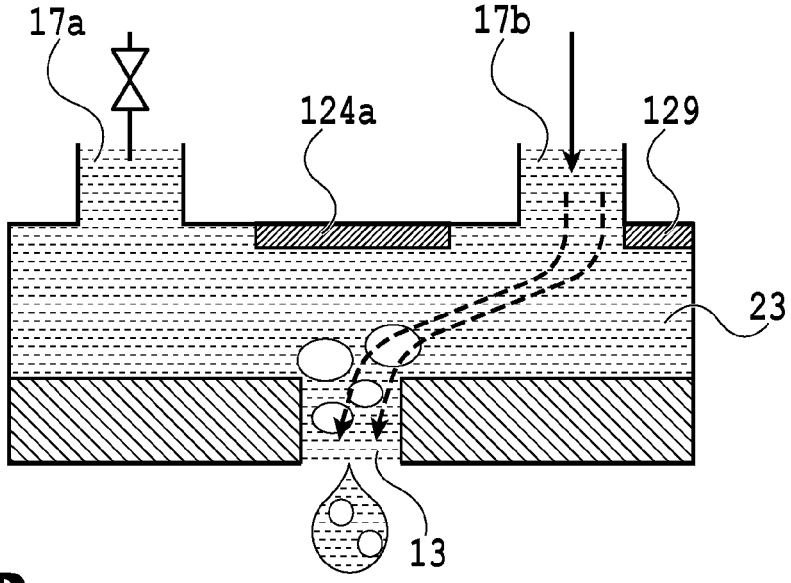
FIG. 14B is a view illustrating another ink flow in a pressure chamber in the kogation removal.

FIGS. 14A and 14B are a diagram and a view respectively illustrating another circulation path for kogation removing cleaning among the circulation paths employed by the printing apparatus 1000 in the present embodiment, and an ink flow in a pressure chamber 23 in the kogation removing cleaning. In the circulation path in FIG. 14A, the valves 242*a*, 242*b*, 241*a*, and 241*b* provided to the channels connected to the common supply channel 211 and the common collection channel 212 are such that the valves 242*a*, 242*b*, and 241*a* are closed, and the valve 241*b* is open. In this state, the ink is supplied from the liquid feed pump P3 to the head side, so that the ink flows in from the collection ports 17*b* but no ink flows in from the supply ports 17*a*. FIG. 14B illustrates the ink flow in a pressure chamber 23 in the circulation path of FIG. 14A. The ink flows in from the collection port 17*b*, so that the inside of the pressure chamber 23 becomes pressurized. As a result, bubbles are discharged from the ejection port 13 with the ink flow. Depending on the size and amount of bubbles generated at the heat applying portion 124*a* and the electrode 129, the bubbles can be efficiently discharged from the ejection port 13 by causing the ink to flow in from the collection port 17*b* and causing no ink to flow in from the supply port 17*a*.

In the printing apparatus 1000 in the present embodiment, a plurality of liquid ejection heads 3 are provided along the surface of the conveyance drum 1, as illustrated in FIG. 1. Thus, the liquid ejection heads 3 are set such that some of them are set to be tilted with respect to the vertical direction (the direction of arrow Z). Specifically, in FIG. 1, the liquid ejection heads 3*a*, 3*b*, 3*d*, and 3*e* are set to be tilted. Moreover, it can be seen that the liquid ejection heads 3*a* and 3*b* and the liquid ejection heads 3*d* and 3*e* differ in tilting direction.

Buoyancy acts on bubbles generated in the pressure chambers 23. Accordingly, in the case where the liquid ejection head 3 is tilted, bubbles generated in its pressure chambers 23 are affected by the tilt so as to move to a higher position in the pressure chambers 23.

Figure 15A:
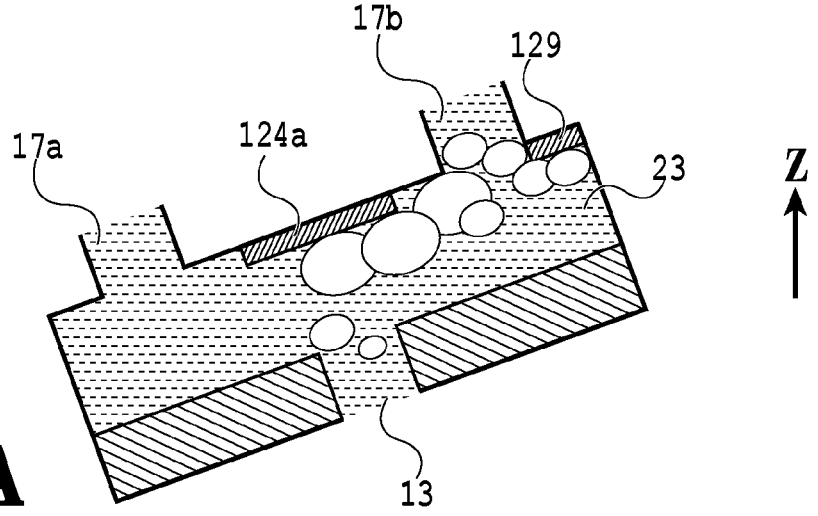
FIG. 15A is a view illustrating a pressure chamber in a tilted liquid ejection head.
Figure 15B:
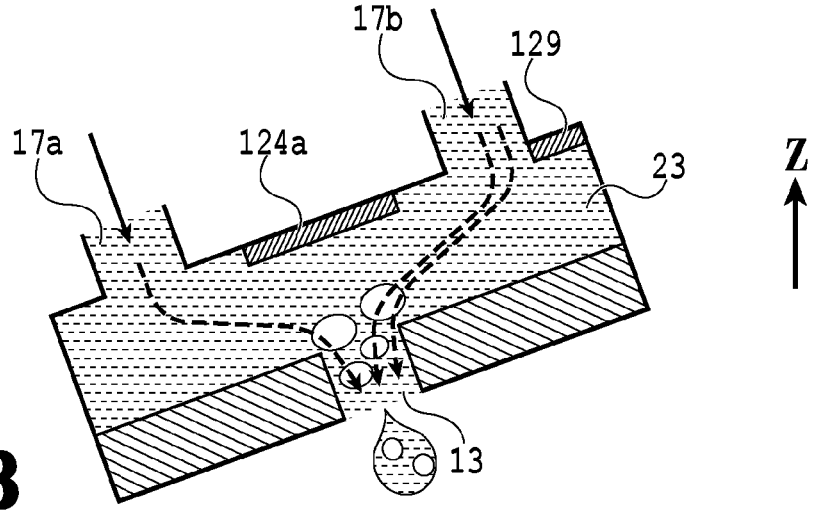
FIG. 15B is a view illustrating the pressure chamber in the tilted liquid ejection head.
Figure 15C:
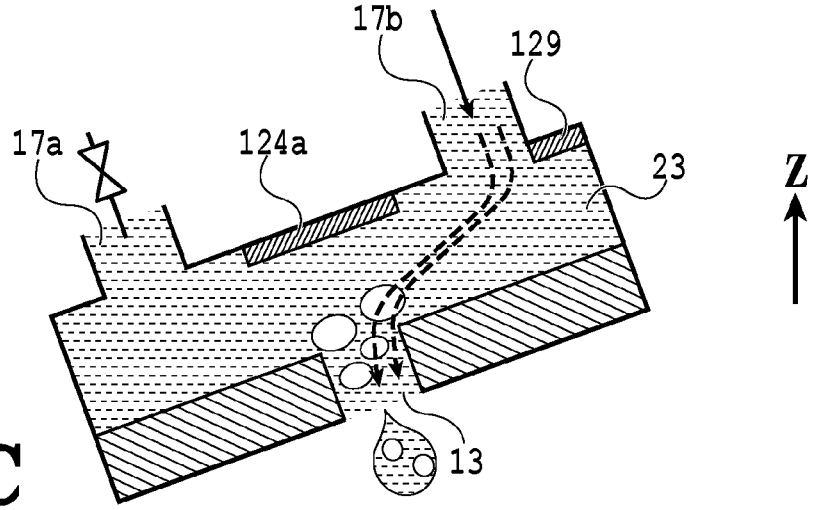
FIG. 15C is a view illustrating the pressure chamber in the tilted liquid ejection head.

FIGS. 15A to 15C are views illustrating a pressure chamber 23 in a tilted liquid ejection head 3. Suppose that the liquid ejection head 3 is tilted in such a direction that the electrodes 129 are positioned higher than the heat applying portions 124*a* and, in this state, bubbles are generated at the heat applying portions 124*a* and the electrodes 129 in the pressure chambers 23. In this case, the bubbles gather on the electrode 129 side, as illustrated in FIG. 15A. In such a state where the bubbles gather on the electrode 129 side, the ink is caused to flow in from the supply ports 17*a* and the collection ports 17*b*, and the flow rate of the liquid to be fed from the liquid feed pump P3 per unit time is set larger than the flow rate of the liquid to be fed from the liquid feed pump P2 per unit time. In this way, the generated bubbles can be efficiently discharged from the ejection ports 13 (see FIG. 15B). Alternatively, depending on the size and amount of bubbles, the ink may be fed from the liquid feed pump P3 to the head side to thereby cause the ink to flow in from the collection ports 17*b* and cause no ink to flow in from the supply ports 17*a*. In this way too, the bubbles can be efficiently discharged from the ejection ports 13 (see FIG. 15C).

Figure 16A:
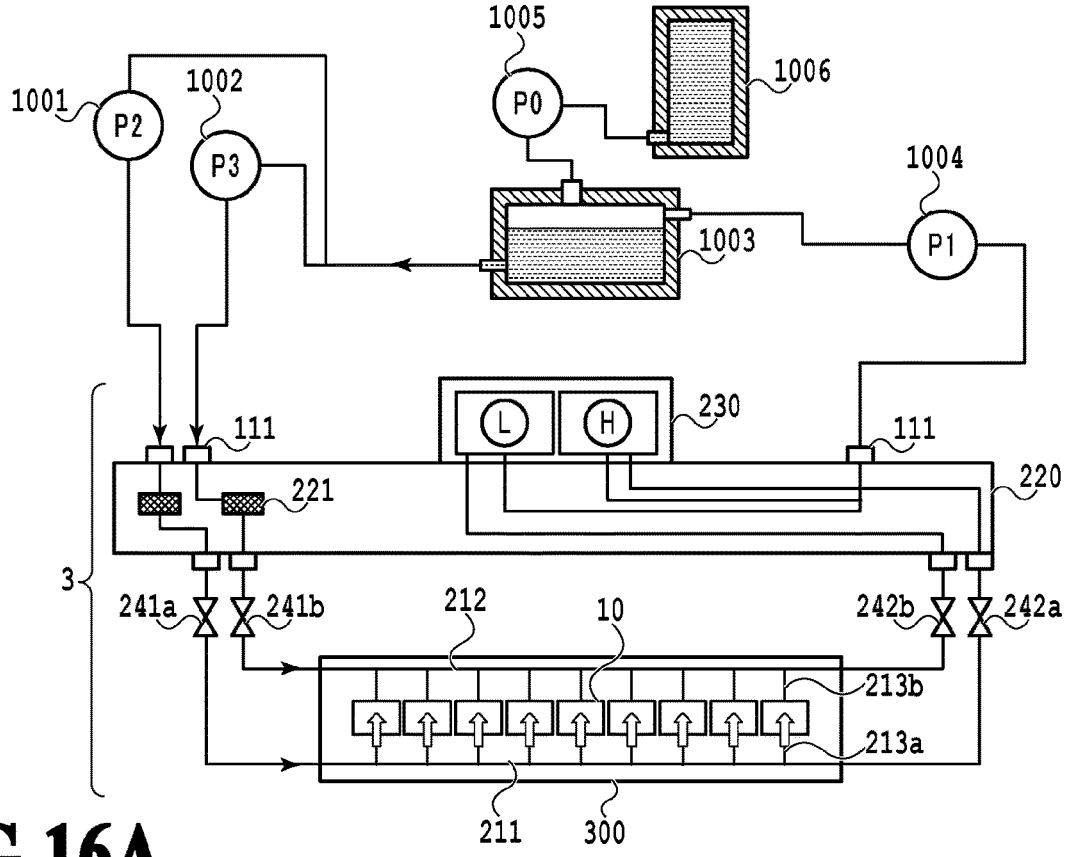
FIG. 16A is a diagram illustrating a circulation path for kogation removing cleaning.
Figure 16B:
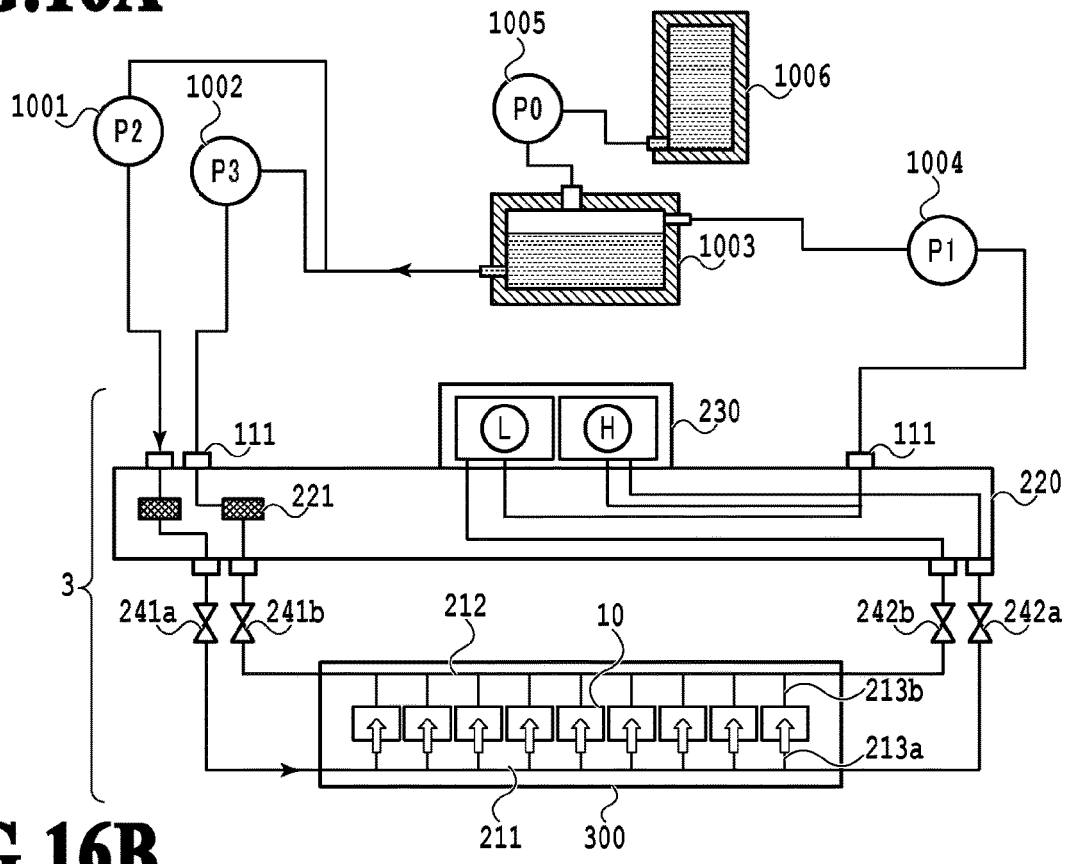
FIG. 16B is a diagram illustrating a circulation path for kogation removing cleaning.

FIGS. 16A and 16B are diagrams illustrating circulation paths for kogation removing cleaning different from the circulation paths in FIGS. 13A and 14A. In the circulation path in FIG. 16A, the valves 242*a*, 242*b*, 241*a*, and 241*b* provided to the channels connected to the common supply channel 211 and the common collection channel 212 are such that the valves 242*a* and 242*b* are closed, and the valves 241*a* and 241*b* are open. In this state, the ink is supplied from the liquid feed pumps P2 and P3 to the head side, and the flow rate of the liquid to be fed from the liquid feed pump P2 per unit time is set larger than the flow rate of the liquid to be fed from the liquid feed pump P3 per unit time. On the other hand, in the circulation path in FIG. 16B, the valves 242*a*, 242*b*, and 241*b* are closed, and the valve 241*a* is open. In this state, the ink is fed from the liquid feed pump P2 to the head side.

Figure 17A:
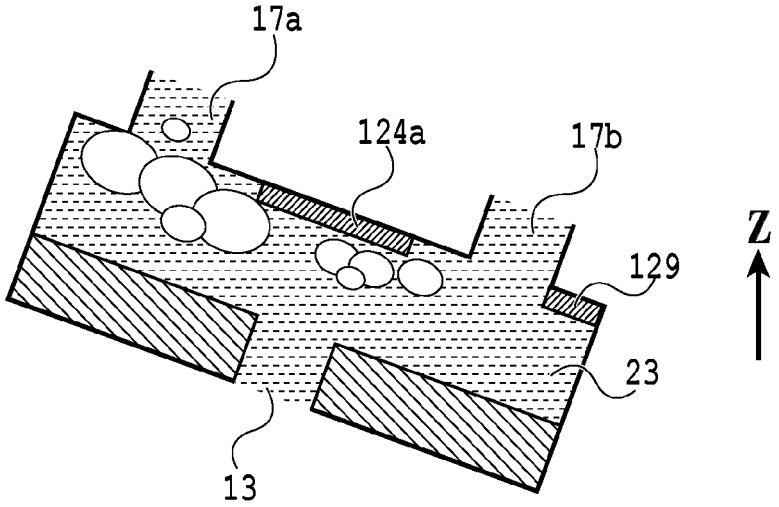
FIG. 17A is a view illustrating a pressure chamber in a tilted liquid ejection head.
Figure 17B:
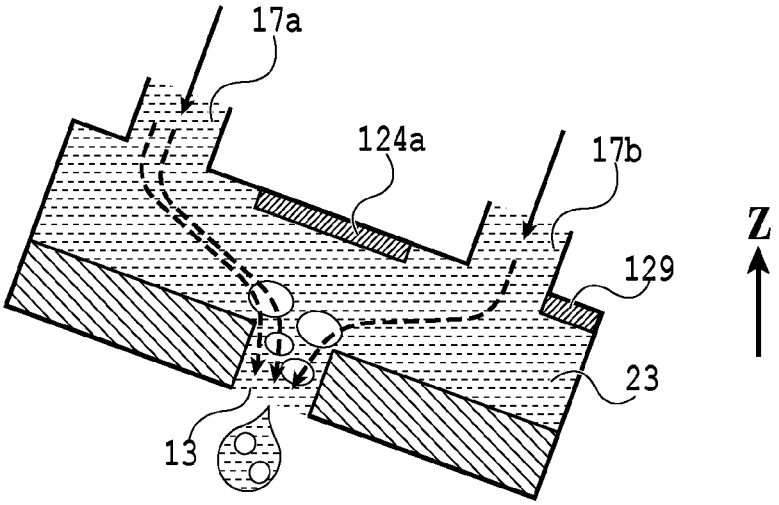
FIG. 17B is a view illustrating the pressure chamber in the tilted liquid ejection head.
Figure 17C:
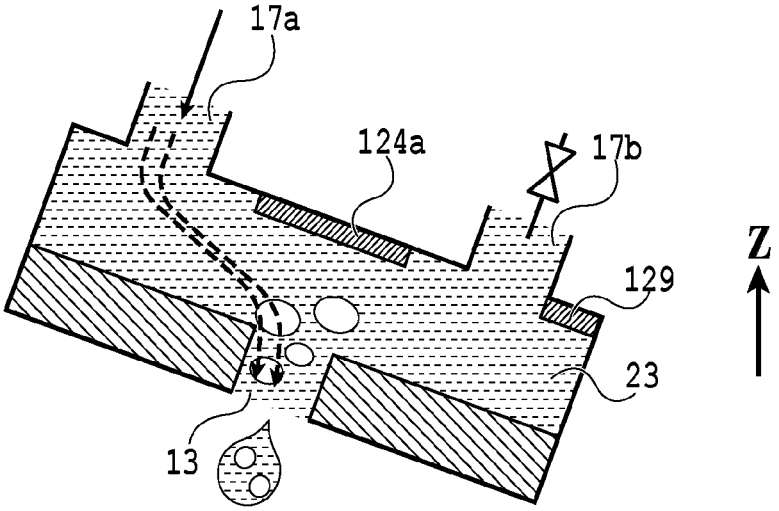
FIG. 17C is a view illustrating the pressure chamber in the tilted liquid ejection head.

FIGS. 17A to 17C are views illustrating a pressure chamber 23 in a liquid ejection head 3 tilted in the direction opposite to that in FIGS. 15A to 15C, and corresponds to the circulation paths illustrated in FIGS. 16A and 16B. Suppose that the liquid ejection head 3 is tilted in such a direction that the electrodes 129 are positioned lower than the heat applying portions 124*a* and, in this state, bubbles are generated at the heat applying portions 124*a* and the electrodes 129 in the pressure chambers 23. In this case, the bubbles gather on the side of the pressure chambers 23 opposite to the electrodes 129, as illustrated in FIG. 17A. In such a case, the ink is circulated through the circulation path illustrated in FIG.

16A to thereby cause the ink to flow in from the supply ports 17*a* and the collection ports 17*b* as illustrated in FIG. 17B. Moreover, the flow rate of the liquid to be fed from the liquid feed pump P2 per unit time is set larger than the flow rate of the liquid to be fed from the liquid feed pump P3 per unit time. In this way, the generated bubbles can be efficiently discharged from the ejection ports 13. Alternatively, the ink is fed from the liquid feed pump P2 to the head side to thereby cause the ink to flow in from the supply ports 17*a* and cause no ink to flow in from the collection ports 17*b* (see FIG. 16B). With such a circulation path too, the bubbles can be efficiently discharged from the ejection ports 13 (see FIG. 17C), depending on the size and amount of the bubbles.

Figure 18:
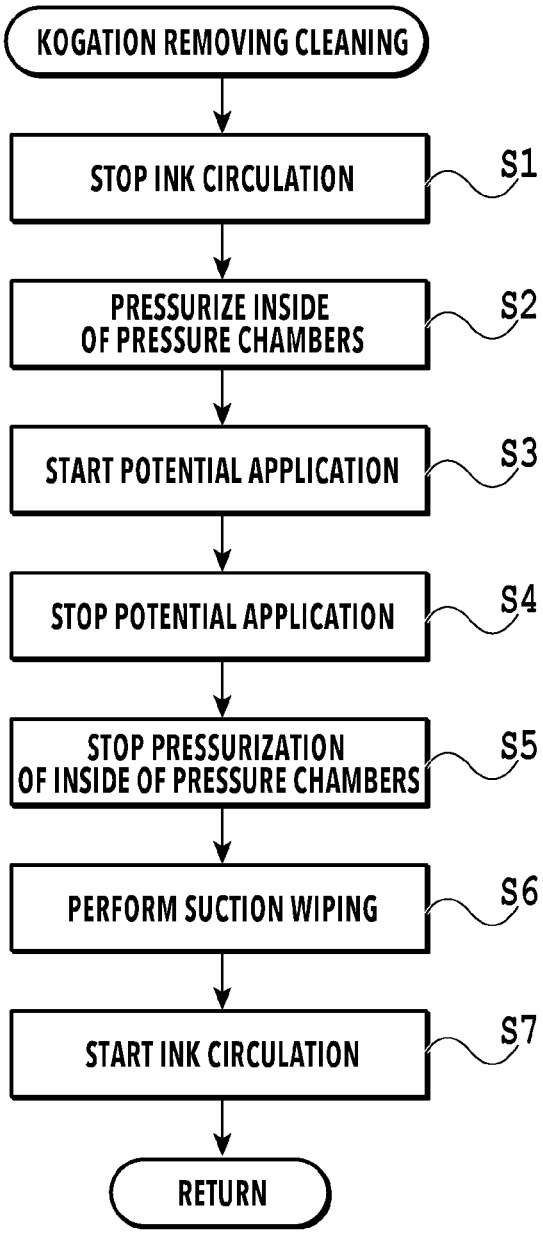
FIG. 18 is a flowchart illustrating a kogation removing cleaning process.

FIG. 18 is a flowchart illustrating a kogation removing cleaning process in the present embodiment. The kogation removing cleaning process in the present embodiment will be described below using this flowchart. A CPU in the printing apparatus 1000 performs the series of processes illustrated in FIG. 18 by loading program code stored in a program memory to a data memory and executing it. Alternatively, the functions of some or all of the steps in FIG. 18 may be implemented with hardware such as an ASIC or an electronic circuit. Meanwhile, the symbol "S" in the description of each process means a step in the flowchart.

Upon start of the kogation removing cleaning process, in S1, the CPU stops the circulation of the ink circulating through a circulation path. Then, in S2, the CPU closes the valves 242*a* and 242*b* and drives the liquid feed pumps P2 and P3 (or one of them) to thereby pressurize the inside of the pressure chambers 23. Thereafter, in S3, the CPU applies a voltage to the heat applying portions 124*a* and the electrodes 129 to thereby apply potentials thereto. As a result, kogation removal is performed on the heat applying portions, and the removed kogation is discharged from the ejection ports 13 along with the bubbles generated at the heat applying portions 124*a* and the electrodes 129. Then, the CPU stops the voltage application in S4, and stops the driven liquid feed pumps (P2, P3) in S5.

Thereafter, in S6, the CPU performs suction wiping that sucks and wipes the surface of the liquid ejection head 3 where the its ejection ports 13 are provided. Then, in S7, the CPU starts the stopped ink circulation, which is the end of the process.

As described above, in each long liquid ejection head with a liquid circulated therethough, the pressure chambers 23 are pressurized and a voltage is applied to the heat applying portions 124*a* and the electrodes 129 to perform kogation removing cleaning. In this way, it is possible to provide a liquid ejection apparatus and a method of controlling a liquid ejection apparatus capable of suppressing an increase in apparatus size and cost and performing kogation removal without a decrease in output.

Another Embodiment

Another embodiment of the present invention will be described below. Note that the basic configuration in this embodiment is similar to that in the above embodiment, and the characteristic configuration will therefore be described below.

In the description of the above embodiment, potentials are applied such that the heat applying portions 124*a* are the anode side and the electrodes 129 are the cathode side. However, in a case where the electrochemical reaction is continued in a state where the polarities of the heat applying portions 124*a* and the electrodes 129 are kept constant, such as the heat applying portions 124*a* being the anode side and the electrodes 129 being the cathode side, the electrolyte component in the ink gets attached to the heat applying portions 124*a* and the electrodes 129. Consequently, the electrolyte component may cover the surfaces of the heat applying portions 124*a* and the electrodes 129. In the case where the electrolyte component covers the surfaces of the heat applying portions 124*a*, it blocks the dissolution of the heat applying portions 124*a* in the electrochemical reaction, which may lead to a failure to remove the kogation attached to the surfaces.

To solve this, in the present embodiment, the polarity of the voltage to be applied is regularly inverted so that the heat applying portions 124*a* and the electrodes 129 will alternately be the anode side and the cathode side. Such voltage application with the polarity switched back and forth enables removal of the electrolyte component in the ink attached to the surfaces of the heat applying portions 124*a* and the electrodes 129. It is therefore possible to remove the kogation on the heat applying portions 124*a* while also suppressing attachment of the electrolyte component to the surfaces of the heat applying portions 124*a*.

Note that while the heat applying portions 124*a* are the cathode side, the heat applying portions 124*a* do not dissolve and therefore kogation removal is not performed. While the heat applying portions 124*a* are the anode side, kogation removal is performed by means of an electrochemical reaction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-154781 filed Sep. 15, 2020, which is hereby incorporated by reference wherein in its entirety.

What is claimed is:

1. A liquid ejection apparatus comprising:

a liquid ejection head that has an electrothermal conversion element which heats a liquid, a heat applying portion to which heat of the electrothermal conversion element is applied, a pressure chamber in which a bubble is generated in the liquid by heat of the heat applying portion, an electrode provided in the pressure chamber and electrically connectable to the heat applying portion through the liquid, which contains an electrolyte, a supply valve capable of opening and closing a supply path through which to supply the liquid to the pressure chamber, and a collection valve capable of opening and closing a collection path into which to collect the liquid from the pressure chamber, and that ejects the liquid from an ejection port communicated with the pressure chamber by means of an action of the electrothermal conversion element;

a voltage application unit capable of applying a voltage to the heat applying portion and the electrode;

a supply pump that supplies the liquid to the pressure chamber; and a control unit that, in a cleaning process, performs control which causes the voltage application unit to apply the voltage to the heat applying portion and the electrode, opens the supply valve, closes the collection valve, and drives the supply pump.

2. The liquid ejection apparatus according to claim 1, wherein the liquid ejection apparatus is configured to, in an ejection period for ejecting the liquid from the ejection port, eject a liquid droplet out of the liquid circulating through the supply valve and the collection valve, the pressure chamber has a supply port through which, in the ejection period, the liquid having flowed through the supply path flows into the pressure chamber, and a collection port through which, in the ejection period, the liquid to be collected into the collection path flows out of the pressure chamber, and in the cleaning process, the liquid flows into the pressure chamber from the supply port and the collection port and is discharged from the ejection port.

3. The liquid ejection apparatus according to claim 2, wherein the heat applying portion is provided between the supply port and the collection port, and the electrode is provided on the collection port side relative to the heat applying portion.

4. The liquid ejection apparatus according to claim 3, wherein in the cleaning process, an amount of inflow of the liquid from the collection port per unit time is larger than an amount of inflow of the liquid from the supply port per unit time.

5. The liquid ejection apparatus according to claim 4, wherein in the cleaning process, the liquid does not flow in from the supply port.

6. The liquid ejection apparatus according to claim 3, wherein in the cleaning process, in a case where the heat applying portion is positioned higher than the electrode, an amount of inflow of the liquid from the supply port per unit time is larger than an amount of inflow of the liquid from the collection port per unit time.

7. The liquid ejection apparatus according to claim 6, wherein in the cleaning process, the liquid does not flow in from the collection port.

8. The liquid ejection apparatus according to claim 1, wherein in the cleaning process, the voltage application unit applies the voltage such that the heat applying portion serves as an anode and the electrode serves as a cathode.

9. The liquid ejection apparatus according to claim 8, wherein the heat applying portion is made of a material containing iridium (Ir), ruthenium (Ru), or platinum (Pt).

10. The liquid ejection apparatus according to claim 8, wherein the heat applying portion is dissolved into the liquid in response to the voltage application unit applying the voltage to the heat applying portion.

11. The liquid ejection apparatus according to claim 8, wherein the voltage application unit alternately performs such voltage application that the heat applying portion serves as an anode and the electrode serves as a cathode and such voltage application that the heat applying portion serves as a cathode and the electrode serves as an anode.

12. A method of controlling a liquid ejection apparatus including a liquid ejection head that has an electrothermal conversion element which heats a liquid, a heat applying portion to which heat of the electrothermal conversion element is applied, a pressure chamber in which a bubble is generated in the liquid by heat of the heat applying portion, an electrode provided in the pressure chamber and electrically connectable to the heat applying portion through the liquid, which contains an electrolyte, a supply valve capable of opening and closing a supply path through which to supply the liquid to the pressure chamber, and a collection valve capable of opening and closing a collection path into which to collect the liquid from the pressure chamber, and that ejects the liquid from an ejection port communicated with the pressure chamber by means of an action of the electrothermal conversion element, a voltage application unit capable of applying a voltage to the heat applying portion and the electrode, and a supply pump that supplies the liquid to the pressure chamber, the method comprising performing control which causes the voltage application unit to apply the voltage to the heat applying portion and the electrode, opens the supply valve, closes the collection valve, and drives the supply pump.

* * * * *